US008833915B2

(12) United States Patent
Plummer

(10) Patent No.: US 8,833,915 B2
(45) Date of Patent: Sep. 16, 2014

(54) INKJET PRINTER

(75) Inventor: Marc Plummer, Huntingdon (GB)

(73) Assignee: Linx Printing Technologies Ltd, Huntingdon (GB)

( * ) Notice: Subject to any disclaimer, the term of this patent is extended or adjusted under 35 U.S.C. 154(b) by 0 days.

(21) Appl. No.: 13/261,549

(22) PCT Filed: Jun. 15, 2011

(86) PCT No.: PCT/GB2011/051115

§ 371 (c)(1),
(2), (4) Date: Dec. 24, 2012

(87) PCT Pub. No.: WO2012/001386

PCT Pub. Date: Jan. 5, 2012

(65) Prior Publication Data

US 2013/0127958 A1 May 23, 2013

(30) Foreign Application Priority Data

Jun. 29, 2010 (GB) ..... 1010902.3

(51) Int. Cl.
*B41J 2/175* (2006.01)
*B41J 2/19* (2006.01)
*B41J 2/18* (2006.01)

(52) U.S. Cl.
CPC .. *B41J 2/19* (2013.01); *B41J 2/175* (2013.01); *B41J 2/18* (2013.01); *B41J 2/17513* (2013.01)
USPC ..... 347/92; 347/85; 347/87; 347/86; 210/650; 210/85; 210/321.68

(58) Field of Classification Search
USPC ..... 347/85–93
See application file for complete search history.

(56) References Cited

U.S. PATENT DOCUMENTS 4,153,902 A * 5/1979 Kanayama ..... 347/92
4,336,037 A 6/1982 Goldis (Continued)

FOREIGN PATENT DOCUMENTS

EP 1541362 A1 6/2005
GB 1553720 A 10/1979

(Continued)

*Primary Examiner* — Matthew Luu
*Assistant Examiner* — Lily Kemathe
(74) *Attorney, Agent, or Firm* — Lynn & Lynn; John H Lynn

(57) ABSTRACT

An ink/air separator for an ink jet printer has one or more plates 77, 79, 81, 83 over which an ink/air mixture can spread. Preferably there is more than one plate, and the mixture overflows from one plate to the next. Preferably adjacent plates are spaced so that as the mixture passes between two plates it contacts the surface above it as well as the surface below it. The plates may be separated by a gap of 10 mm or less, e.g. a gap of 2 mm to 5 mm, where they overlap Preferably some or all of the plate surfaces contacted by the mixture are roughened. Interaction between the ink/air mixture and the plate surface tends to slow the flow of very small air bubbles and encourage them to accumulate and/or merge, so that they separate from the ink more quickly than individual small bubbles. The ink/air separator may be connected in the path of unused ink returned from the gutter 27 of a continuous ink jet printer to an ink tank 39, or may be placed inside the ink tank 39.

18 Claims, 17 Drawing Sheets

(56) References Cited

U.S. PATENT DOCUMENTS

| | | | | |
|---|---|---|---|---|
| 4,811,035 | A * | 3/1989 | Huliba et al. | 347/89 |
| 5,677,718 | A | 10/1997 | Crawford | |
| 6,113,778 | A * | 9/2000 | Kemp et al. | 210/85 |
| 6,165,365 | A * | 12/2000 | Salyer et al. | 210/650 |
| 6,270,211 | B1 * | 8/2001 | Long et al. | 347/92 |
| 7,203,992 | B2 * | 4/2007 | Pogacar et al. | 15/353 |
| 7,571,997 | B2 * | 8/2009 | Nakamura | 347/92 |
| 2002/0051039 | A1 | 5/2002 | Moynihan | |
| 2002/0196316 | A1 | 12/2002 | Nakamura | |
| 2008/0149528 | A1 * | 6/2008 | Sumi et al. | 206/710 |
| 2009/0147064 | A1 | 6/2009 | Ito | |
| 2010/0134571 | A1 | 6/2010 | Shimizu | |
| 2011/0001771 | A1 | 1/2011 | Heylen | |
| 2011/0011785 | A1 * | 1/2011 | Herman et al. | 210/321.68 |

FOREIGN PATENT DOCUMENTS

| | | | |
|---|---|---|---|
| GB | 2232933 | A | 1/1991 |
| JP | 2007136760 | A | 6/2001 |
| JP | 20011328283 | A | 11/2001 |
| JP | 2003237099 | A | 8/2003 |
| WO | 0061373 | A1 | 10/2000 |

* cited by examiner

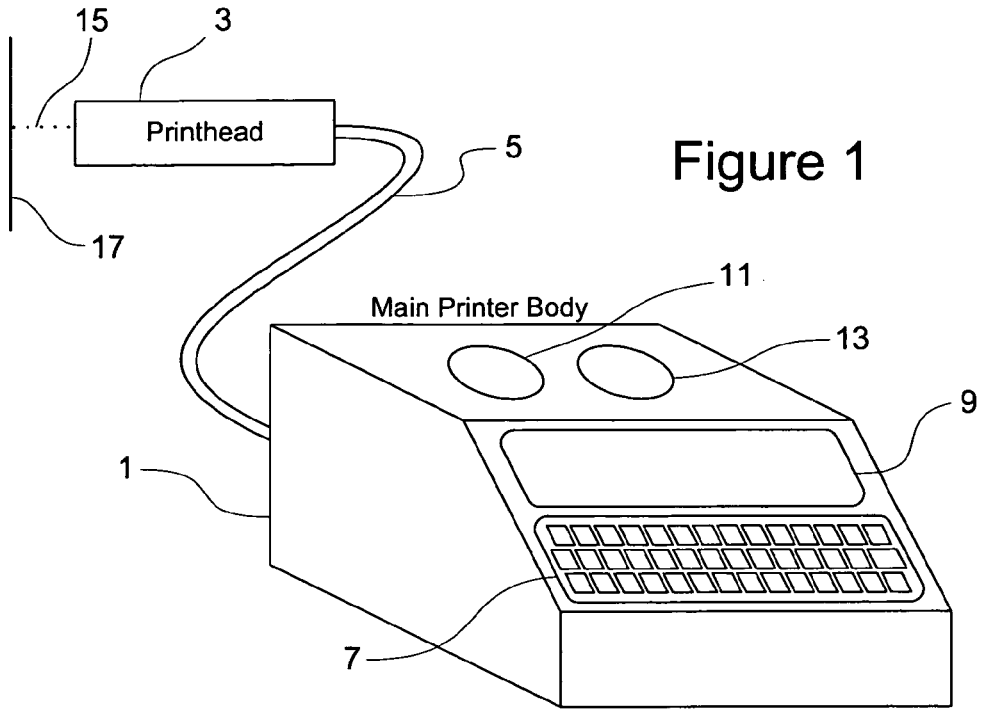
Figure 1
Figure 2
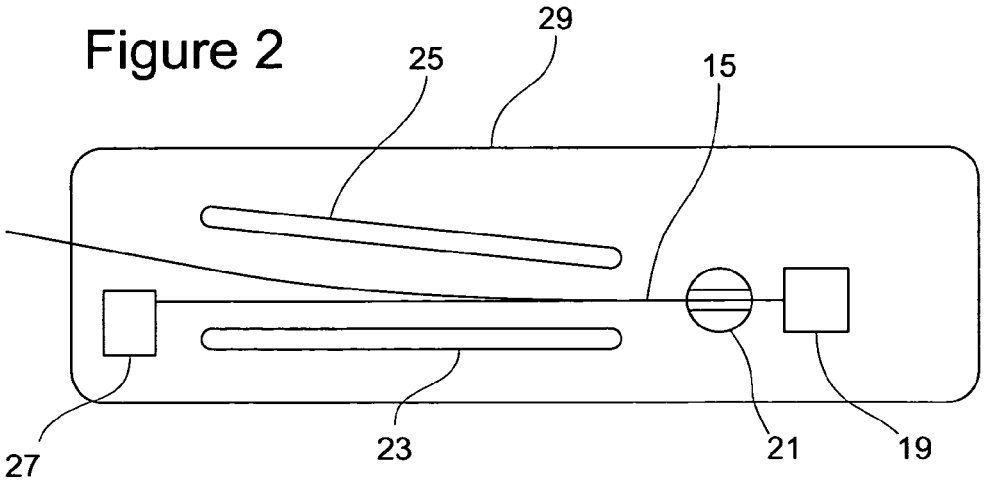
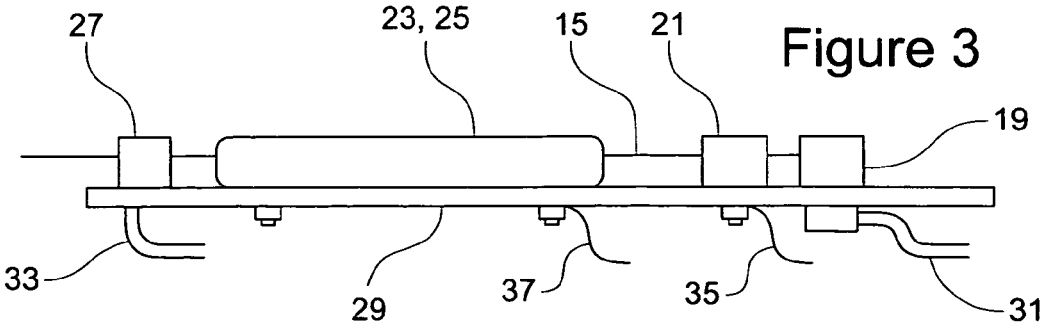
Figure 3

Figure 11
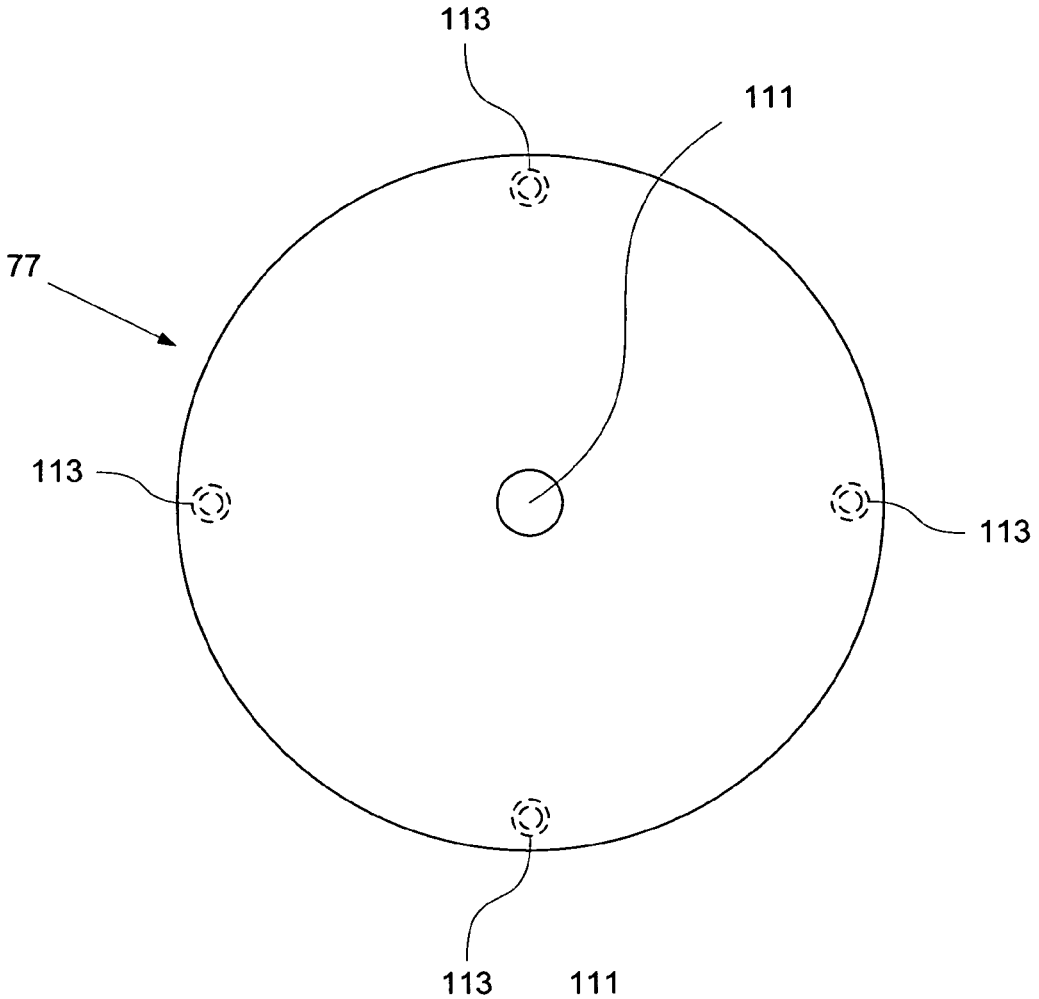
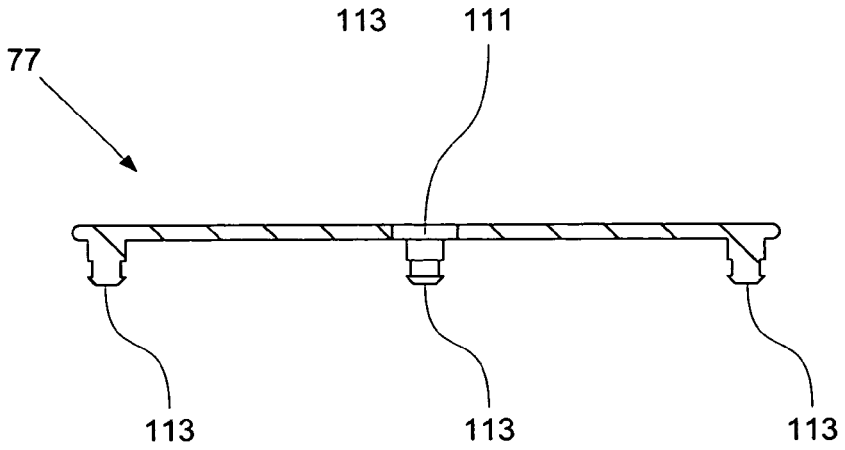
Figure 12

Figure 13
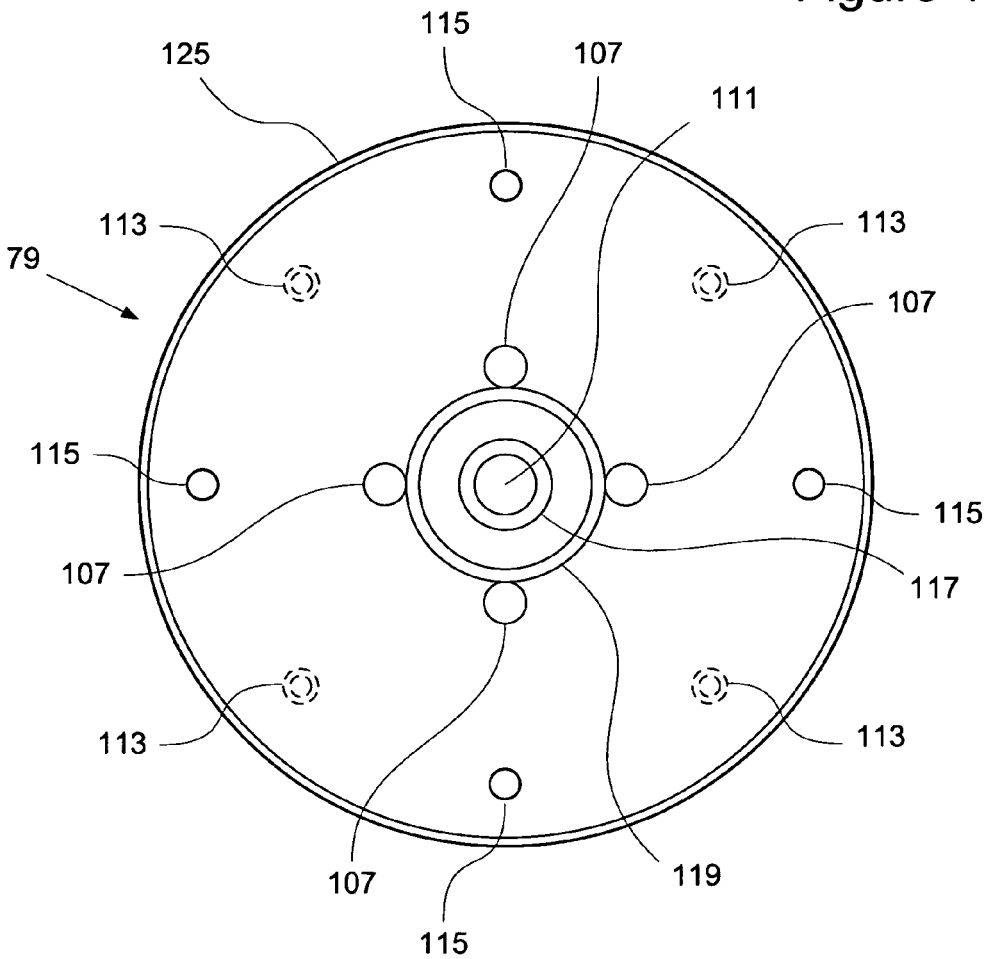
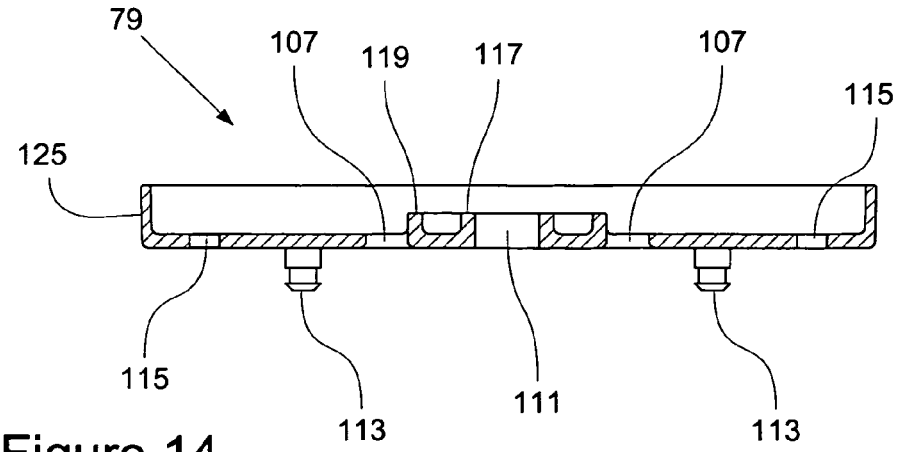
Figure 14

Figure 15
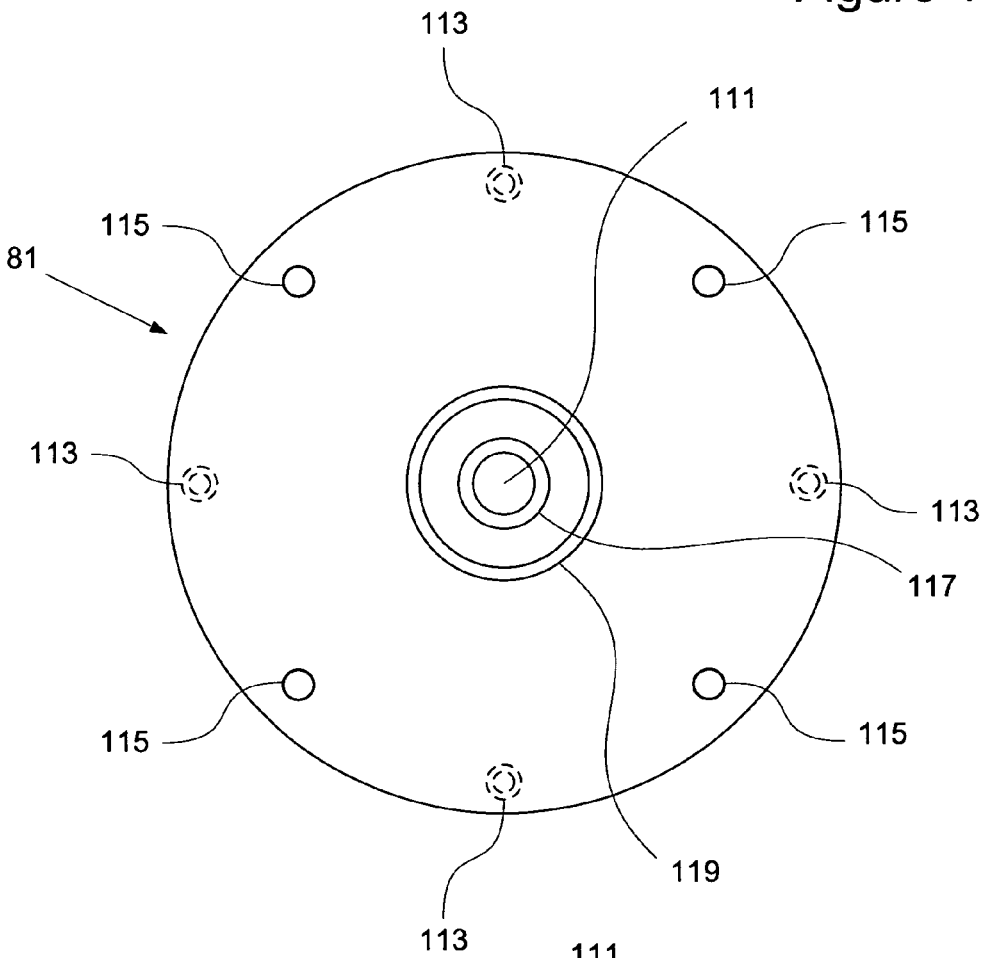
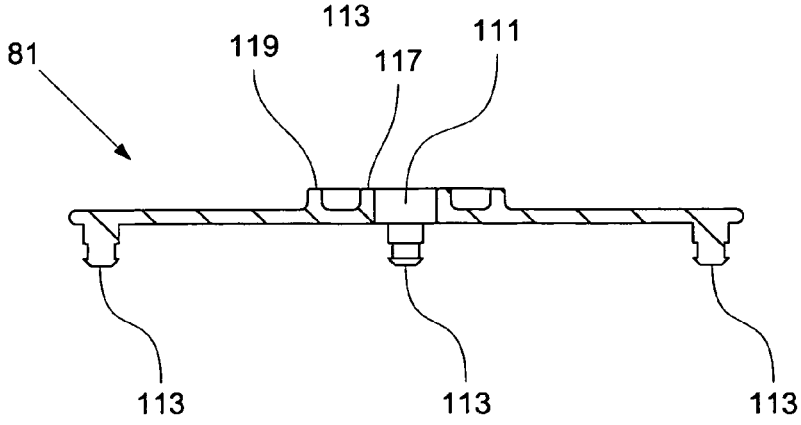
Figure 16

Figure 17
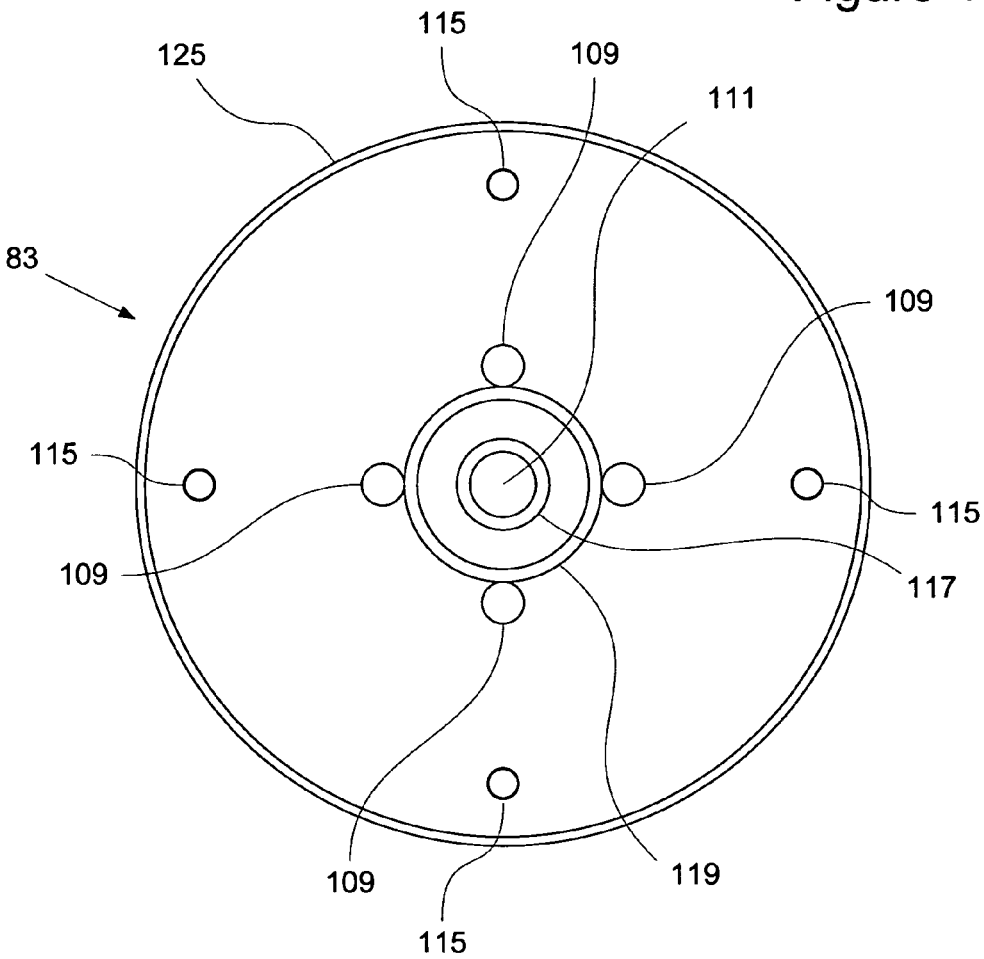
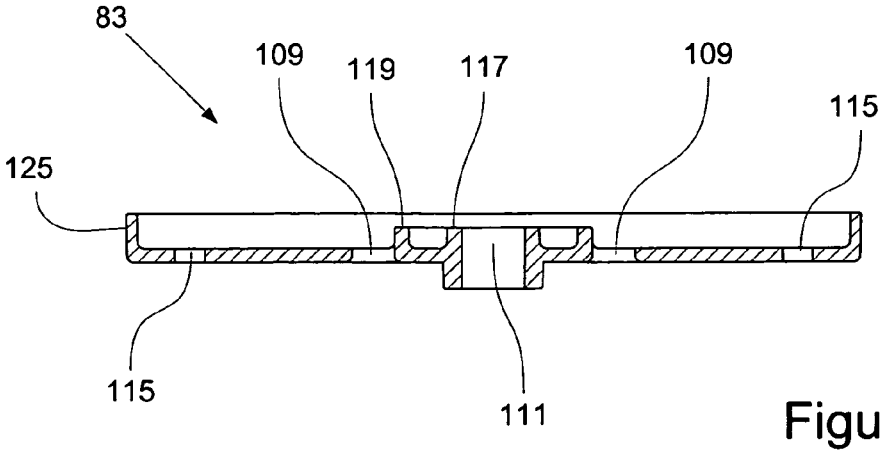
Figure 18

Figure 19
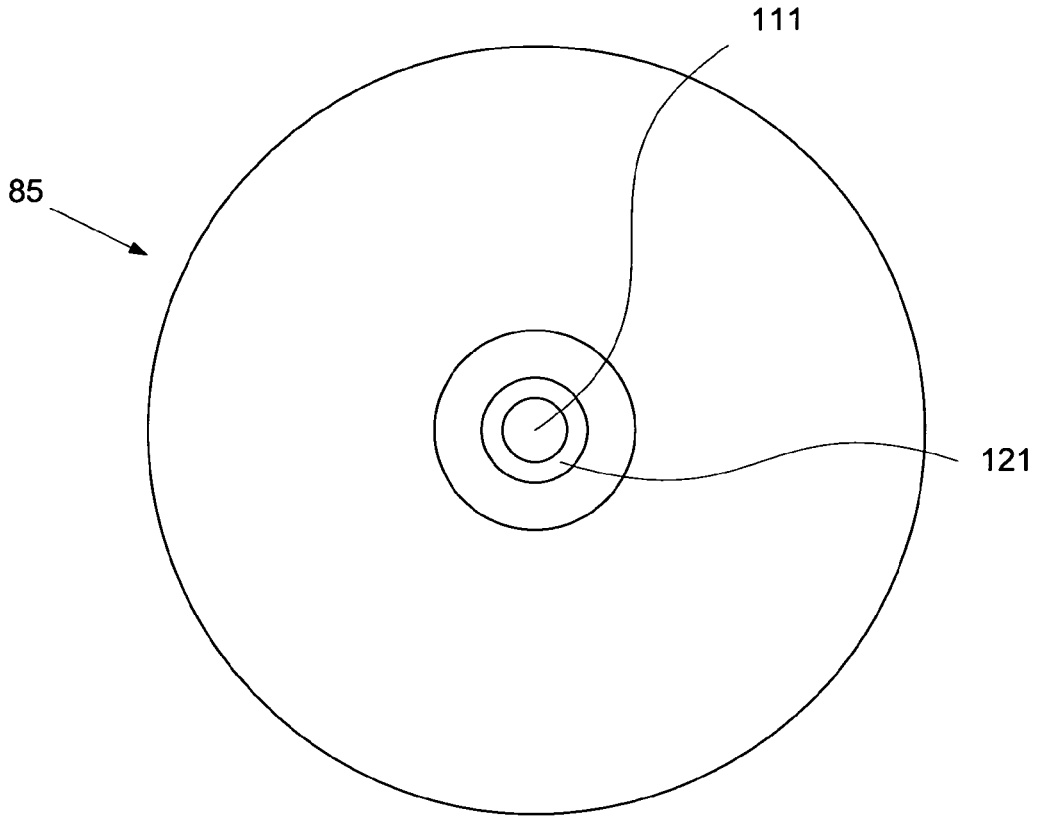
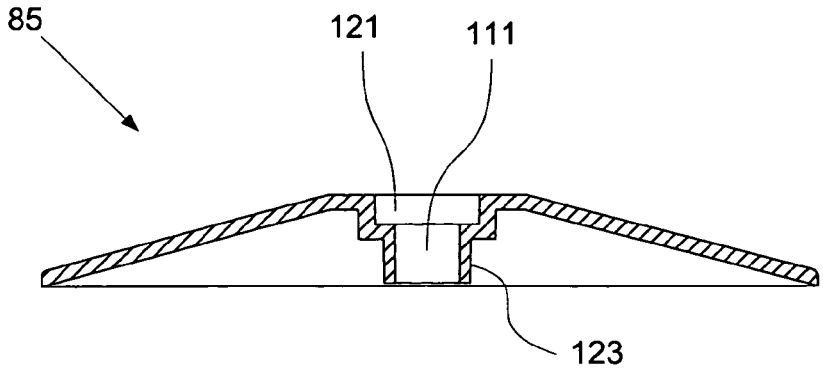
Figure 20

Figure 26
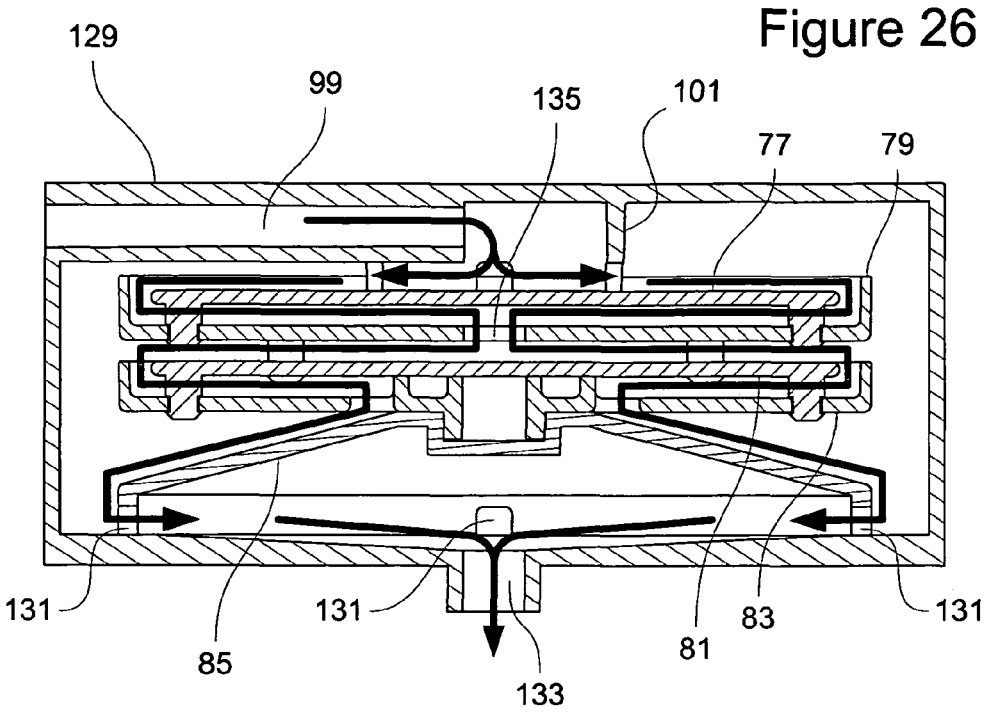
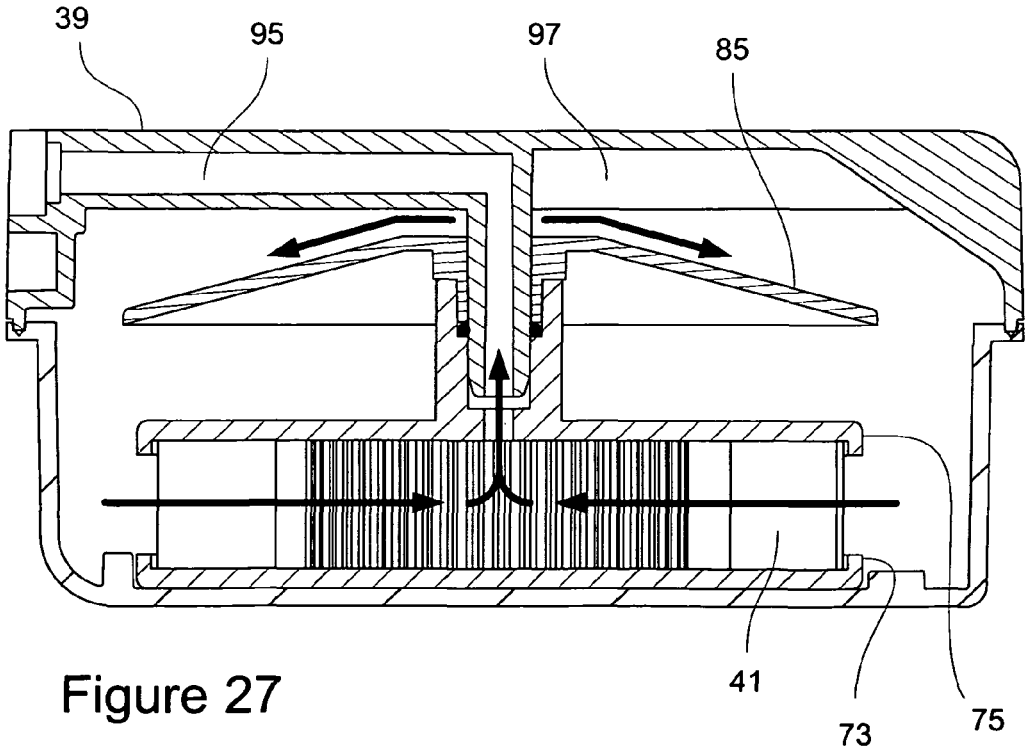
Figure 27

INKJET PRINTER

CROSS REFERENCE TO RELATED APPLICATION

Priority is claimed based on Application GB 1010902.3 filed 29 Jun. 2010 and upon International Patent Application PCT/GB2011/051115 filed 29 Jun. 2011.

BACKGROUND OF THE INVENTION

The present invention relates to an ink jet printer and an arrangement for promoting the separation of ink and air in an ink jet printer. Aspects of the invention also provide an ink tank for use in an ink jet printer, the ink tank comprising the arrangement for promoting separation of ink and air and optionally also comprising a filter, and a removable module comprising the ink tank.

Continuous ink jet printers are commonly used for printing identification and other variable data on industrial products and packaging. During operation of a continuous ink jet printer, a continuous stream of ink drops is generated and means are provided for deflecting the drops in flight, so that different drops can travel to different destinations. Since the drops are generated continuously, only some of the drops will be required for printing. Accordingly, the drops required for printing are arranged to travel in a direction so that they reach the surface to be printed onto, whereas drops which are not required for printing are arranged to travel to a means, usually known as a gutter, where they are collected. In almost all modern continuous ink jet printers, ink collected at the gutter is returned to an ink tank, from which ink is supplied to the means (sometimes called the ink gun) which creates the stream of ink drops. Such printers are commonly known as continuous ink jet printers because the ink jet is produced even at moments when ink is not required for printing, as opposed to drop-on-demand printers in which the printing process involves producing only the ink drops required to be printed.

Typically, the ink is electrically conductive when wet, and an arrangement of electrodes is provided to trap electric charges on the ink drops and create electrostatic fields in order to deflect the charged drops. The ink gun, the various electrodes and the gutter are fixed in the appropriate spatial relationship in a printhead. Various tanks, pumps, control circuits and the like are housed within a printer body, and the head is usually connected to the body by a flexible conduit carrying fluid lines and electrical wiring, which may be a few meters long.

The ink contains one or more colouring substances together with various other components such as a binder resin, carried in a solvent such as methylethylketone, acetone or ethanol. The solvent is highly volatile, to ensure that the printed ink drops dry quickly. Consequently, the solvent has a tendency to evaporate from the ink during operation of the printer, so that the ink in the ink tank becomes too concentrated. Accordingly, a typical ink jet printer will also have a tank of spare solvent, also housed in the main body, and an arrangement for monitoring ink viscosity directly or indirectly. When the viscosity exceeds a predetermined level, a small dose of solvent will be transferred from the solvent tank into the ink tank to dilute the ink.

In order that the ink collected by the gutter should be conveyed along the gutter line away from the gutter, suction is usually applied to the gutter line from a suction source, typically in the main printer body. The fluid travelling along the gutter line will be a mixture of ink and air. Air inevitably enters the gutter both as a result of the suction applied to the gutter line and because the ink drops moving through the air from the ink gun to the gutter inevitably entrain some air in their path. Therefore the ink returning from the gutter to the ink tank becomes mixed with air.

If this air remains in the ink when the ink is returned to the ink gun, it will tend to disrupt the formation of the ink jet. For example, the ink may be at a pressure of approximately three times atmospheric pressure immediately before it leaves the ink gun through the jet-forming nozzle. At this pressure, any air mixed in with the ink will be substantially compressed. Immediately the ink leaves the nozzle, it will be exposed to atmospheric pressure. This pressure change will cause any air mixed into the ink to expand abruptly, disrupting the jet. Additionally, air bubbles can partially block the nozzle, which may make the ink jet become unstable or non-uniform, which in turn interferes with the break-up of the jet into drops so that the drops are incorrectly deflected. The incorrect deflection both results in incorrect printing and ink contamination of the printhead and/or the surface being printed onto. Partial blockage of the nozzle may also change the direction of travel of the ink jet, causing it to strike components of the printhead. Therefore it is desirable to ensure that the air that gets mixed into the ink as it returns to the ink tank is substantially separated out of the ink before the ink is returned to the ink gun.

The ink also tends to accumulate undesirable particulate matter, such as dried ink particles, dust, and the like. It is desirable to remove this particulate matter from the ink, since it may cause problems, for example by totally or partially blocking the nozzle of the ink gun. The ink may be passed through a filter to remove such material. However, under some circumstances air that is mixed into the ink may pass through the filter, especially if the air is in the form of very small bubbles, and so the filter cannot be relied on to prevent air from remaining in the ink that is returned to the ink gun.

BRIEF SUMMARY OF THE INVENTION

In one aspect, the present invention provides an arrangement for promoting the separation of ink and air comprising at least one plate arranged so that in use ink can flow across an upper surface of the plate. Preferably there are a plurality of plates that overlap each other at least partially so that ink can flow across the upper surface of each plate in turn. Preferably the plates are generally parallel, at least at the parts where they overlap.

Another aspect of the present invention provides an assembly comprising the arrangement for promoting the separation of ink and air, together with an ink filter positioned below the arrangement.

Yet another aspect of the invention provides an ink tank for an ink jet printer, the tank containing the arrangement for promoting the separation of ink and air, either with or without an ink filter. In a still further aspect, the invention provides a removable module comprising the ink tank, optionally with a handle.

Further aspects of the invention provide an ink jet printer comprising the arrangement for promoting the separation of ink and air, or comprising the assembly, the ink tank or the removable module.

Another aspect of the present invention provides a method of separating air from ink in an ink jet printer in which the ink containing the air to be separated from it is passed over at least one generally horizontal plate. Preferably the ink is passed in turn over a plurality of plates that overlap each other at least partially. Preferably the plates are parallel, at least where they overlap. Preferably the plate or plates are in an ink tank, and ink that has passed over the plate or plates passes towards the bottom of the tank and then leaves the tank. The tank may or may not also contain an ink filter through which the ink passes before leaving the tank.

In aspects of the invention that comprise an ink tank containing the plate or plates, the ink tank may be an ink feed tank that holds a volume of ink to be fed to another part of the fluid system of the printer. In operation, the tank may be controlled to contain an amount in the range of from 100 ml to 1000 ml of ink, for example, it may be controlled to hold between 500 ml and 550 ml of ink. Other arrangements are also possible. For example, the tank may be a dedicated air separation tank, and the tank may be arranged not to hold any significant volume of ink beyond the ink that is passing through the arrangement for promoting the separation of ink and air.

Preferably each plate is at least 50 mm across, and may conveniently be in the range of 80 to 120 mm across, on its longest dimension (or its diameter if circular). Preferably each plate has an area (per face) of at least 2000 $mm^2$, and may conveniently have an area (per face) in the range of 5000 $mm^2$ to 14000 $mm^2$. The area referred to here is the "macroscopic" area such as is calculated from the length of the sides of a rectangle or from the radius of a circle. It is believed that as the ink (or more correctly, the ink/air mixture) flows across the face of a plate, the interaction between the surface of the plate and air bubbles entrained in the ink tend to slow the air bubbles and tend to make them aggregate and/or merge, thereby making it easier for the bubbles to separate from the ink under the effect of gravity. If the plate is smaller than indicated above, the small surface area per plate means that an inconveniently large number of plates are likely to be needed to provide enough separation between the ink and the air to be of practical benefit. The plates may be larger than is indicated above, but as the size of each plate increases it may become difficult to fit the overall arrangement into the body of an ink jet printer if a compact design is desired.

Preferably the separation between adjacent plates is 10 mm or less where the plates overlap, more preferably in the range of 2 mm to 5 mm, at least in the case of the gap between one pair of adjacent plates. More preferably, this is the case for most or all of the separations between adjacent plates. Depending on factors such as the volume flow rate of ink through the arrangement and the overall size of the plates, this separation between adjacent plates may cause the ink, or bubbles or froth floating on the top of the ink, to contact the underside of the plate above it. This provides a further surface on which bubbles may congregate, and may also tend to slow the flow rate of bubbles, allowing more time for them to separate from the ink.

Preferably at least part of the upper side, and more preferably both sides, of at least one and preferably most or all plates is textured rather than being perfectly smooth where the surface comes into contact with the ink in use. The degree of texturing may provide a roughness having an $R_a$ in the range of 1.5 to 20 μm. The roughened surface appears to interact with the microbubbles in the ink to a greater extent than a perfectly smooth surface, thereby promoting the tendency of the bubbles to clump and merge with each other and also tending to slow down the flow of bubbles. This is desirable because the larger the size of a bubble and the longer the time that it spends flowing over the plates, the more it will tend to separate from the ink. The effect is believed to arise because the roughness increases the effective surface area of the plate at a microscopic level, thereby providing an increased area for the microbubbles to interact with.

The plates are preferably generally planar, but do not necessarily need to be precisely flat. For example, a plate may be ridged or domed so as to spread the flow of ink, or be dished or have a rim around part or all of its circumference in order to collect and retain ink or control its flow. However, it is preferable to avoid any shape that would tend to define flow channels that would concentrate the ink into streams, since this would speed up the ink flow and reduce the interaction between the ink and the surface of the plate.

A sloping plate may additionally be provided below the aforementioned plate or plurality of plates. This provides a surface down which the ink can flow in order to join a volume of at least partially de-aerated ink. Such an arrangement allows the ink flowing into the volume to join it smoothly, without creating new bubbles or becoming mixed into the existing ink in the volume. This allows the ink in the volume to be stratified, with newly-joined ink that may still contain some residual air bubbles lying above ink that has been in the volume longer. This enables any residual air bubbles to rise out of the ink as the ink moves down to the bottom of the volume, so that ink drawn from the bottom of the volume is better de-aerated than ink freshly joining the volume.

In a preferred embodiment, the flow of ink over the plates alternates between flow in a direction away from the edge of the plate and towards the centre of the plate on one plate, and flow in a direction away from the centre of the plate and towards the edge of the plate on the next or previous plate. In a construction suitable for use with this flow pattern, a plate intended for flow away from the edge may have a raised rim, to prevent the ink from overflowing the edge of the plate, and one or more holes at locations inward from the rim to allow the ink to flow through the plate. Also, in a construction suitable for use with this flow pattern, a plate intended for flow towards the edge may be rimless for at least a part of its edge, to allow the ink to overflow the edge and, in this case, may be without any hole to allow ink to flow through the plate.

In one embodiment, an ink tank assembly for an ink jet printer includes a housing and a fluid inlet disposed in the housing. A plate including a top surface is disposed inside the housing and configured to receive liquid from the fluid inlet and spread the liquid along the top surface. Either the plate is arranged for liquid to overflow its edge or an opening is disposed in the plate for liquid to flow through. A liquid holding region is provided in a bottom portion of the housing. The liquid holding region is configured to receive liquid that has overflowed the edge of the plate or that has passed through the opening in the plate. A filter assembly includes a filter medium having a first filter medium side and a second filter medium side. The filter assembly is disposed in the housing and in fluid communication with the liquid holding volume. The filter assembly is configured to filter liquid through the filter medium assembly from first filter medium side to the second filter medium side. A fluid outlet is in fluid communication with the second filter side of the filter medium.

In another embodiment, a method of removing air from an ink composition includes providing a separation assembly with a plate comprising a top surface. An ink composition is disposed onto the top surface of the plate and spread along the top surface to encourage the growth of air bubbles and slow the flow rate of the ink composition. The ink composition flows downwardly through holes in the plate or over the edge of the plate. Bubbles stick to each other and/or merge into larger bubbles, separate from the ink composition, and are removed in the form of air from the separation assembly. The ink composition is collected in a fluid holding region. The ink composition is filtered through a filter assembly. The filtered ink composition is then removed from the separation assembly.

In summary, an ink/air separator for an ink jet printer has one or more plates, which may or may not have a rim, over which an ink/air mixture can spread. Preferably there is more than one plate, and the mixture overflows from one plate to the next. Preferably adjacent plates are spaced so that as the mixture passes between two plates it contacts the surface above it as well as the surface below it. Preferably some or all of the plate surfaces contacted by the mixture are roughened. Interaction between the ink/air mixture and the plate surface tends to slow the flow of very small air bubbles and encourage them to accumulate and/or merge, so that they separate from the ink more quickly than individual small bubbles. The ink air separator may be connected in the path of unused ink returned from the gutter of a continuous ink jet printer to an ink tank, or may be placed inside the ink tank.

Embodiments of the invention may include some or all of the features discussed in paragraphs 0001 to 0007 above. For example, a preferred embodiment of a printer comprises an ink gun or other means to eject a continuous ink jet that separates into ink drops, an arrangement of electrodes to trap electric charges on the ink drops and create electrostatic fields in order to deflect the charged drops, a gutter or other means to catch ink drops that are not used for printing, a gutter line for receiving the ink from the gutter or other means to catch ink drops, a suction source for applying suction to the gutter line to suck ink in the gutter line away from the gutter or other means, an ink tank to receive ink from the gutter line, and an arrangement for promoting the separation of ink and air, the arrangement either being in the ink tank or upstream of it ("upstream" being defined with reference to the flow of ink from the gutter or other means to the ink tank). The ink gun, the various electrodes and the gutter may be fixed in an appropriate spatial relationship in a printhead.

BRIEF DESCRIPTION OF THE DRAWINGS

FIG. 1 shows an ink jet printer suitable for incorporating an embodiment of the present invention.

FIG. 2 is a plan view showing the main components of a printhead for the printer of FIG. 1.

FIG. 3 is a side view showing the main components of a printhead for the printer of FIG. 1.

FIG. 11 is a top view of the upper rimless flat plate of the ink/air separation arrangement in the ink feed tank of FIG. 5.

FIG. 12 shows a section through the plate of FIG. 11.

FIG. 13 is a top view of the upper rimmed flat plate of the ink/air separation arrangement in the ink feed tank of FIG. 5.

FIG. 14 shows a section through the plate of FIG. 13.

FIG. 15 is a top view of the lower rimless flat plate of the ink/air separation arrangement in the ink feed tank of FIG. 5.

FIG. 16 shows a section through the plate of FIG. 15.

FIG. 17 is a top view of the lower rimmed flat plate of the ink/air separation arrangement in the ink feed tank of FIG. 5.

FIG. 18 shows a section through the plate of FIG. 17.

FIG. 19 is a top view of the conical sloping plate of the ink/air separation arrangement in the ink feed tank of FIG. 5.

FIG. 20 shows a section through the plate of FIG. 19.

FIG. 26 shows a section through the ink/air separation tank in the fluid system of FIG. 25.

FIG. 27 shows a section through the ink feed tank in the fluid system of FIG. 25.

DETAILED DESCRIPTION OF THE EMBODIMENTS

Figure 4:
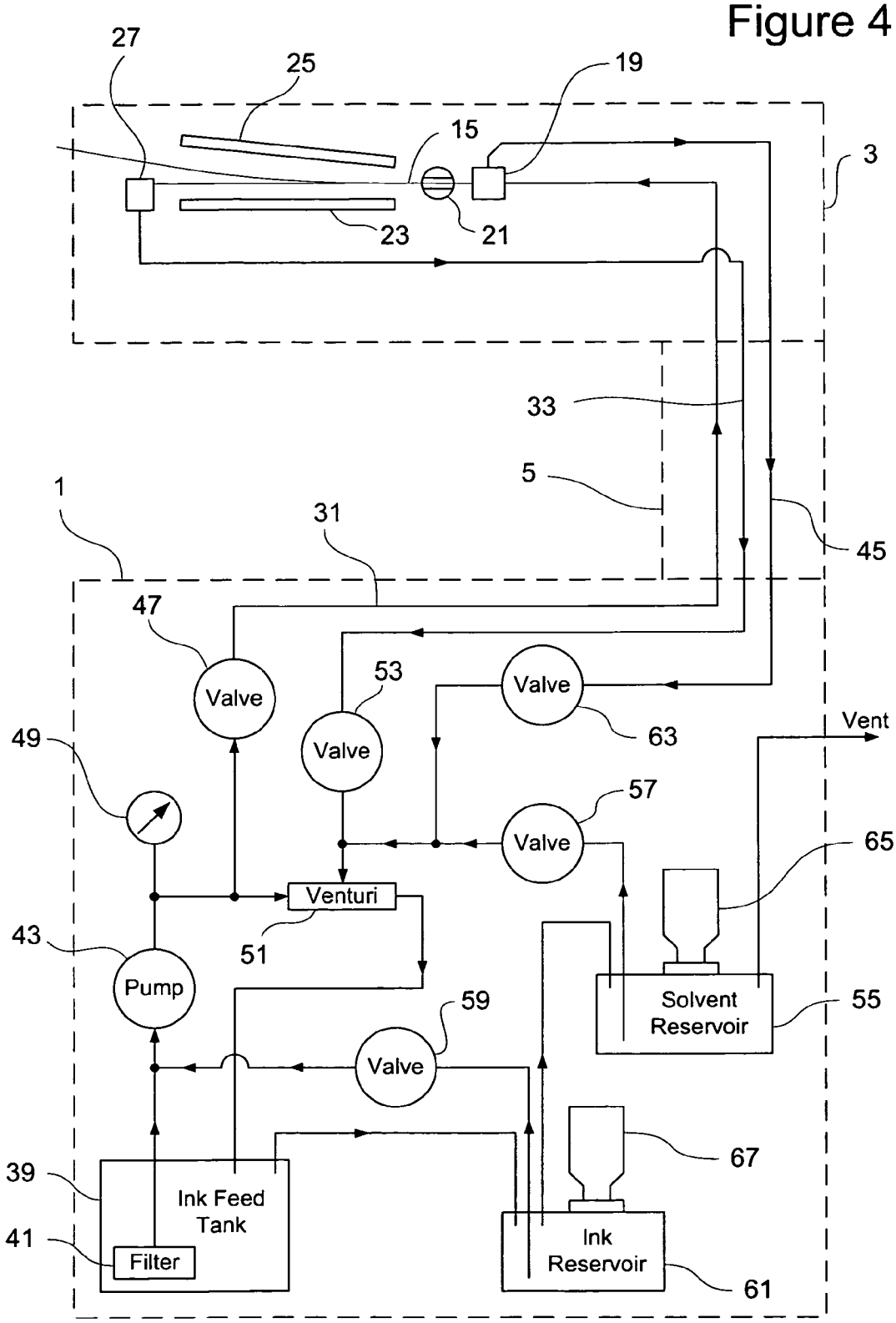
FIG. 4 is a schematic diagram of part of the fluid system of the printer of FIG. 1.

Embodiments of the invention, given by way of non-limiting example, will now be described with reference to the drawings.

FIG. 1 shows an ink jet printer. The printer has a main body 1 and a printhead 3, joined by a flexible conduit 5 (sometimes also known as an umbilical).

The main body 1 has a keypad 7 and a display 9 to enable the operator to communicate with it. The body 1 contains most of the pumps, tanks, valves and control electronics of the printer. Removable filler covers 11, 13 provide access to tanks for ink and solvent (sometimes referred to as diluent), so as to enable the tanks to be refilled.

The ink jet is formed at the printhead 3, and accordingly the printhead includes the components which must be situated in the vicinity of the jet. The conduit 5, which is typically between 1 and 10 m long, provides a flexible connection carrying the fluid and electrical lines which need to run between the main body 1 and the printhead 3. Although in principle it is possible for the printhead components to be mounted in or on the main printer body, so that no separate printhead and conduit are required, the illustrated arrangement allows the relatively small printhead to be mounted in the required position for printing while the relatively bulky body 1 can be mounted at a more convenient location for operator access.

As shown in FIG. 1, an ink jet 15 issues from the printhead 3 to the surface 17 which is to be printed on to. The direction of the ink jet 15 is varied as the surface 17 moves past the printhead 3, so as to print the desired text or pattern onto the surface. Many types of article may provide the surface 17, such as product packaging, jam jars and other similar consumer goods requiring "sell by" dates or code numbers to be printed onto them, pharmaceutical blister packs, pharmaceutical tablets and individual food items such as eggs, or a continuous product such as a pipe or electric cable.

FIG. 2 shows the layout of the main functional components of the printhead 3 in a schematic plan view, and FIG. 3 shows the main functional components in a schematic side view.

During operation of the printer, the ink jet 15 issues continuously from a jet-forming nozzle of an ink gun 19. The ink leaves the ink gun 19 as a continuous unbroken jet of ink, but the jet 15 rapidly breaks up into separate ink drops. A charge electrode 21 is provided at the location where the ink jet 15 breaks into separate drops. As shown in FIGS. 2 and 3, the electrode has a slot through which the jet 15 passes, so as to provide a high degree of electrical coupling between the ink jet 15 and the charge electrode 21. Many other designs of charge electrode are also known, such as an enclosed tunnel through which the jet passes.

The ink is electrically conductive while wet, and the ink gun 19 is maintained at a constant potential (normally ground). Consequently, any voltage on the charge electrode 21 induces a corresponding charge in the part of the continuous portion of the ink jet 15 that is electrically coupled to the charge electrode 21. As the ink jet 15 breaks into drops, while still electrically coupled to the charge electrode 21, this induced charge is trapped on the drops. In this way, the voltage applied to the charge electrode 21 controls the amount of electric charge trapped on the ink drops. Typically, a pressure vibration is applied to the ink in the ink gun 19 so as to control the manner in which the ink jet 15 breaks into drops, and the signal applied to the charge electrode 21 is synchronized with this pressure vibration so that the charge trapped on each successive drop of the ink jet is controlled individually.

After leaving the vicinity of the charge electrode 21, the ink drops enter a strong electric field (the deflection field) formed by a potential difference of several kilovolts between two deflection electrodes 23, 25. Uncharged drops are not deflected by the deflection field, and continue to travel in the direction in which the ink jet 15 initially leaves the ink gun 19. However, charged drops are deflected, so as to change the direction of travel, to an extent dependent on the level of charge on the drop (and also such matters as the mass of the drop and the drop velocity, both of which are kept constant in normal operation). By way of illustration, FIG. 2 shows the path of undeflected drops, and the path of deflected drops for one particular degree of deflection provided as an example.

Not all ink drops in the ink jet 15 are required for printing the desired text or pattern on the surface 17. Therefore a gutter 27 (also sometimes known as an ink catcher) is placed so that undeflected drops enter an ink-receiving orifice of the gutter 27 and do not pass to the surface 17. The ink caught by the gutter 27 is carried back to the main printer body 1 and returned to the ink tank, for reuse. In operation of the printer, the smallest amount of deflection which can be applied to an ink drop used for printing is the amount of deflection which is just enough to ensure that the drop does not collide with the gutter 27, and the largest amount of deflection that can be used for printing is the amount of deflection such that the ink drop does not quite collide with the deflection electrode 25 (with an appropriate safety margin in both cases).

As shown in FIG. 3, the ink gun 19, the charge electrode 21, the deflection electrodes 23, 25 and the gutter 27 are mounted on the upper surface of a board 29, and the necessary fluid and electrical connections are made to the components from the underside of the board 29. The ink is pressurised by a pump in the main printer body 1 and the ink is supplied under pressure through an ink feed line 31 (which passes along the conduit 5) to the ink gun 19. A suction source in the main printer body 1 supplies suction through a gutter line 33 (which also passes along the conduit 5) so as to suck away the ink which enters the gutter 27. The deflection voltage and the drive signal for the charge electrode 21 are also generated in the main printer body 1 and are connected to the respective electrodes 21, 23, 25 by electrical lines 35, 37 (which also pass through the conduit 5). Other fluid and electrical connections may also be provided to the printhead, such as connections for sensor electrodes which detect the passage of charged ink drops and fluid lines for providing solvent and suction to the ink gun 19 for purging and flushing, as will be familiar to those skilled in the art.

FIG. 4 is a schematic diagram of the main parts of the fluid system in an ink jet printer embodying the present invention. The ink used to form the ink jet 15 is stored in an ink feed tank 39. Ink in the ink feed tank 39 is drawn out through a filter 41 by a pump 43. Ink pressurised by the pump 43 flows into the ink feed line 31 through a feed valve 47. The ink pressure at the output side of the pump 43 is measured by a pressure transducer 49. During normal operation, a feedback control system controls the pump 43 in response to the output from the pressure transducer 49 so as to keep the ink pressure at a preset value. The ink feed line 31 extends out of the main printer body 1, along the conduit 5 and into the printhead 3 to the ink gun 19. If the feed valve 47 is open, ink pressurised by the pump 43 will flow along the ink feed line 31 to the ink gun 19, and form the ink jet 15.

The output of the pump 43 is also connected to the input of a Venturi suction device 51. Ink leaving the Venturi suction device 51 flows back into the ink feed tank 39. For as long as the pump 43 is running, ink will flow out of the ink feed tank 39, through the pump 43 and the Venturi suction device 51, and back to the ink feed tank 39, regardless of whether or not any ink is flowing through the ink feed line 31 to the ink gun 19. The Venturi suction device 51 is arranged to use the Venturi effect to generate suction at suction inlet(s) thereof.

As discussed above with reference to FIGS. 2 and 3, the ink jet 15 leaves the ink gun 19, passes close to the charge electrode 21, and through the deflection field created by the deflection electrodes 23, 25. Ink drops which are not required for printing are caught by the gutter 27. The gutter line 33 extends from the gutter 27 through the conduit 5 to a suction inlet of the Venturi suction device 51, via a gutter valve 53. During normal operation, the gutter valve 53 is open and suction from the Venturi suction device 51 sucks ink out of the gutter 27 and along the gutter line 33. Ink (and also air in the gutter line 33) entering the Venturi suction device 51 flows out into the ink feed tank 39 along with the ink that has entered the Venturi suction device 51 from the pump 43. Additionally, a purge line 45 is provided, which allows suction to be applied to the interior of the ink gun 19 if necessary. The purge line 45 passes from the ink gun 19 in the printhead 3 through the conduit 5 to a suction inlet of the Venturi suction device 51 in the printer main body 1. It is controlled by a purge valve 63.

During operation of the printer, there is a tendency for solvent to evaporate from the ink that circulates from the ink feed tank 39 along the ink feed line 31, the ink jet 15 and the gutter line 33, with the result that the viscosity of the ink will slowly increase. In order to keep the viscosity within desired limits, additional solvent is added as necessary from a solvent reservoir 55. Various ways are known of monitoring the ink viscosity. Solvent is added by opening a solvent top-up valve 57 briefly, connecting the solvent reservoir 55 to a suction input of the Venturi suction device 51. Consequently, a small amount of solvent is sucked out of the solvent reservoir 55 into the Venturi suction device 51, and then flows into the ink feed tank 39 so as to dilute the ink.

Additionally, ink is slowly used up during operation of the printer. If the level of ink in the ink feed tank 39 becomes too low, an ink top-up valve 59 is opened briefly, enabling the pump 43 to suck additional ink out of an ink reservoir 61. This additional ink flows through the pump 43 and the Venturi suction device 51 into the ink feed tank 39, so as to replenish the amount of ink in the ink feed tank 39.

The solvent reservoir 55 and the ink reservoir 61 are refilled from respective containers 65, 67, commonly referred to as bottles or cartridges, which are connected to the reservoirs 55, 61 and removed from them as necessary by the operator, through the filler covers 11, 13 shown in FIG. 1.

Air in the gutter line 33 is sucked into the Venturi suction device 51 along with ink collected by the gutter 27, and is discharged into the ink feed tank 39. Consequently, the ink feed tank 39 must be vented, so that this air can escape. Additionally, the ink reservoir 61 and the solvent reservoir 55 also need to be vented, in order to maintain them at ambient pressure. The ink feed tank 39, the ink reservoir 61 and the solvent reservoir 55 could each be vented separately. However, in the present embodiment the ink feed tank 39 is vented into the ink reservoir 61, and the ink reservoir 61 is vented in turn into the solvent reservoir 55. The solvent reservoir 55 is vented to outside the printer main body 1.

The Venturi suction device 51 delivers a mixture of ink and air to the ink feed tank 39. At least some of the air in the mixture is in the form of very small bubble ("microbubbles") entrained in the ink. In the present embodiment, the ink filter 41 is made up of a cylindrical (annular) woven polythene (WPE) pleat filter rated at 10 μm followed by a cylindrical scavenge stainless steel filter rated at 40 μm. If microbubbles are present in the ink as it approaches this filter arrangement, a substantial proportion of the microbubbles will pass through the filter and result in the presence of air in the ink fed to the ink gun 19. This can be avoided by ensuring that the ink tank holds a large volume of ink relative to the volume flow rate of ink through the ink tank 39. The mixture of ink and entrained microbubbles is less dense than pure ink, and will float above it. The ink filter 41 is at the bottom of the ink feed tank 39, and if enough time is allowed for the microbubbles to rise through the ink, the ink at the level of the filter will remain substantially free of microbubbles.

However, it is now desired to make the ink feed tank relatively small, and to hold only a small amount of ink in it, for various reasons. First, the present applicant proposes to make the ink feed tank as a user-replaceable module (a so-called "service module"). This will allow the user to replace the ink feed tank 39 whenever the filter 41 needs to be changed. By replacing the whole ink feed tank 39, the filter change operation becomes easier and less messy than if the tank had to be opened and the filter removed and replaced. Additionally, if the whole ink feed tank 39 is replaced, the ink contained in it is also discarded. This ensures that the ink used in the printer is refreshed from time to time, which is beneficial since the quality of the ink can deteriorate with extended use. It is convenient for the user if this replaceable ink feed tank 39 can be made small for easy handling. Second, reducing the amount of ink held in the ink feed tank 39 has the effect of reducing the amount of ink that is lost in refreshing the ink, which minimises waste and cost to the user. Third, it is generally desirable to reduce the size of the ink feed tank 39 in order to reduce the overall size of the printer main body 1, so as to make the printer more easily portable and easier to fit into the packing line or other installation where it is to be used.

In order to allow the ink feed tank 39 to contain a smaller amount of ink, without problems arising because of air reaching and passing through the ink filter 41, the ink feed tank 39 contains an arrangement for promoting the separation of ink and air.

Figure 5:
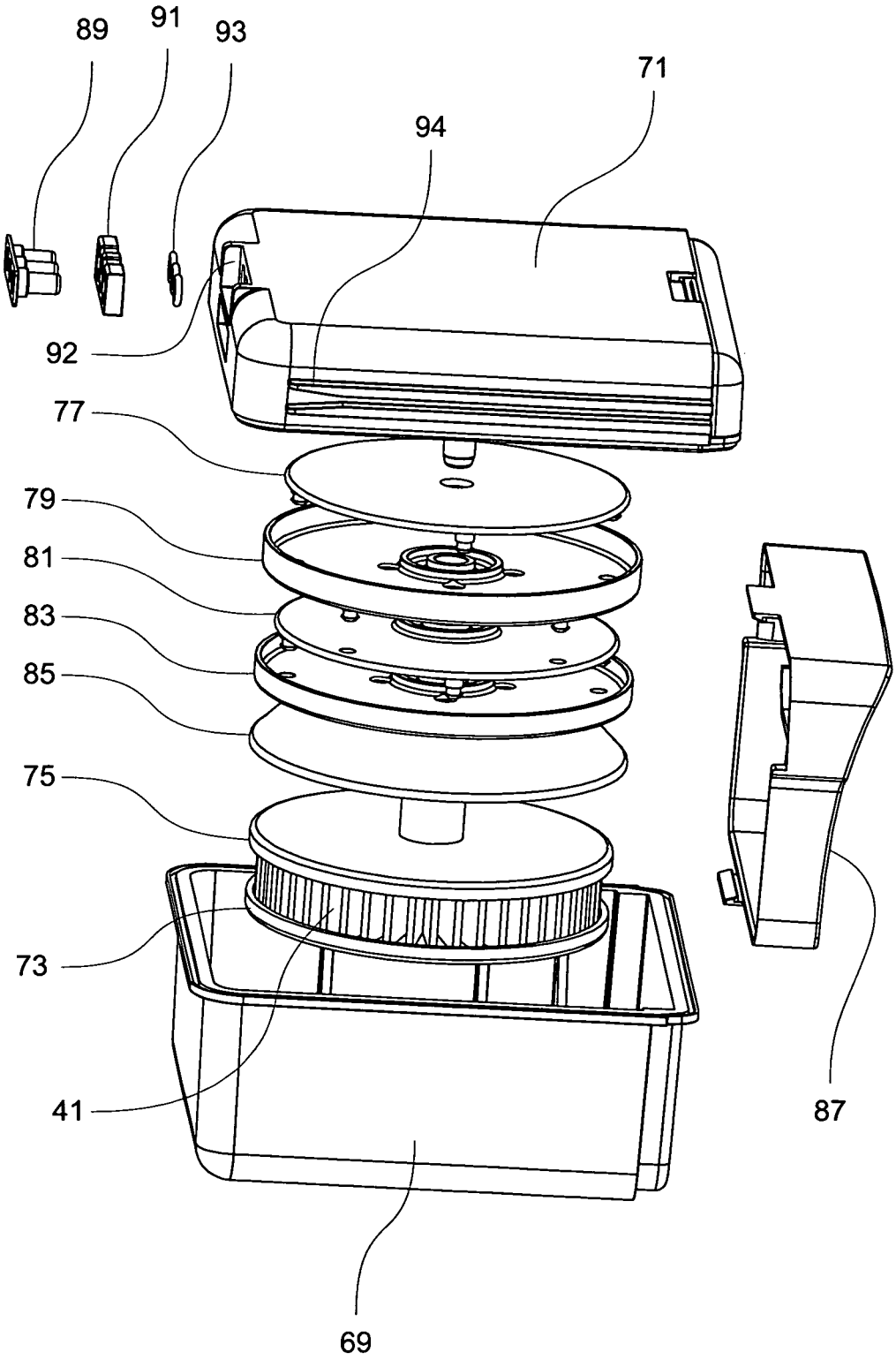
FIG. 5 is an exploded view of the ink feed tank, and its main contents, in the printer of FIG. 1, according to a first embodiment of the present invention.

FIG. 5 is an exploded view of the ink feed tank 39 together with the main components contained within it. In this embodiment, the ink feed tank 39, together with the components contained within it, forms a removable and replaceable service module that can be inserted into the main body 1 of the printer, and removed from it, as necessary by the operator. The ink feed tank 39 has a base portion 69 and a lid portion 71, which are securely bonded together in use (e.g. by ultrasonic welding) so as to form an ink-tight seal where they join. Inside the ink feed tank 39 there is a filter assembly made up of the ink filter 41, a filter base plate 73 and a filter top plate 75. The arrangement for promoting the separation of ink and air is made up of four flat plates 77, 79, 81, 83, that overlap each other substantially entirely and are generally parallel to each other, and a sloping conical plate 85. The plates 77, 79, 81, 83, 85 are supported in use by a tubular upward extension from the centre of the filter assembly top plate 75.

After the base portion 69 and the lid portion 71 of the ink feed tank 39 have been assembled together, a handle 87 is clipped over one end of the ink feed tank 39 and may be ultrasonically welded to it. This is to assist the user when fitting the ink feed tank 39 into the main body 1 of the printer and when removing the ink feed tank 39 from the main printer body 1.

The base portion 69, the lid portion 71 and the handle 87 of the ink feed tank 39; base plate 73 and top plate 75 of the filter assembly; and the plates 77, 79, 81, 83, 85 of the arrangement for promoting the separation of ink and air may all, for example, be moulded from polypropylene. As previously mentioned, the ink filter 41 itself may comprise a woven polyethylene pleated filter rated at 10 μm together with an internal scavenge stainless steel cylinder filter rated at 40 μm.

Figure 6:
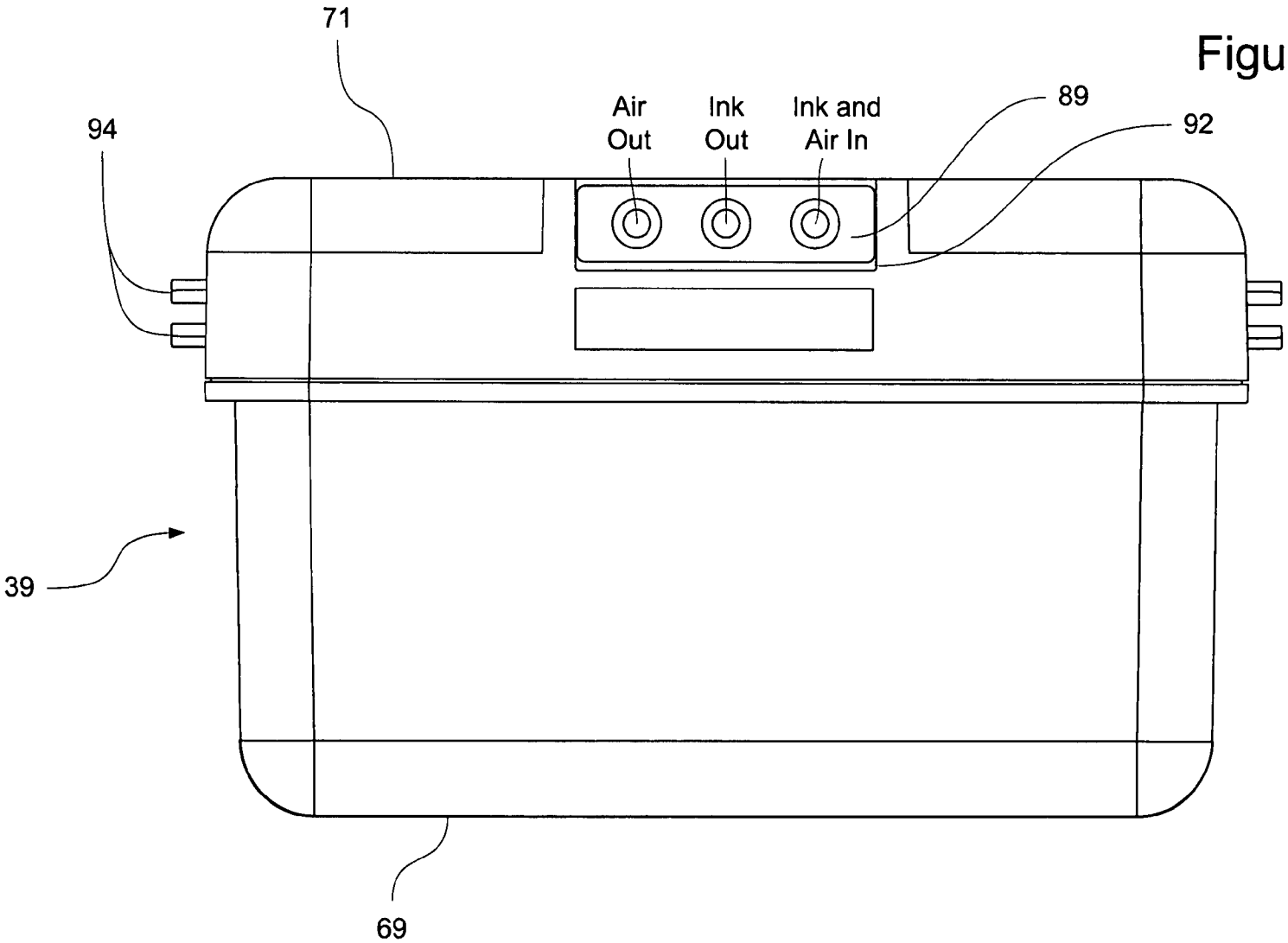
FIG. 6 is an end view of the ink tank of FIG. 5 in its assembled state.

Fluid connections to the ink feed tank 39 are made near the top of the lid portion 71, at the opposite end of the ink feed tank 39 from the handle 87. This end of the ink feed tank 39 is shown in FIG. 6. The fluid lines connect to respective ports in a port plug 89. The three ports of the port plug 89 extend through respective holes in a seal plate 91, which fits in a recess 92 in the end of the lid portion 71 of the ink feed tank 39. As shown in FIG. 5, O-rings 93 are compressed between the seal plate 91 and the end surface of the recess 92, to ensure a fluid-tight seal.

As shown in FIG. 6, three fluid connections are provided. One connection receives the ink and air mixture output from the Venturi suction device 51. The second connection provides the ink outlet to the pump 43. The third connection provides the air vent outlet. These correspond to the three connections shown for the ink feed tank 39 in FIG. 4.

Flanges 94 on either side of the lid portion 71 co-operate in use with corresponding flanges within the main body 1 of the printer to locate the ink feed tank 39 in the correct position when it is inserted.

Figure 7:
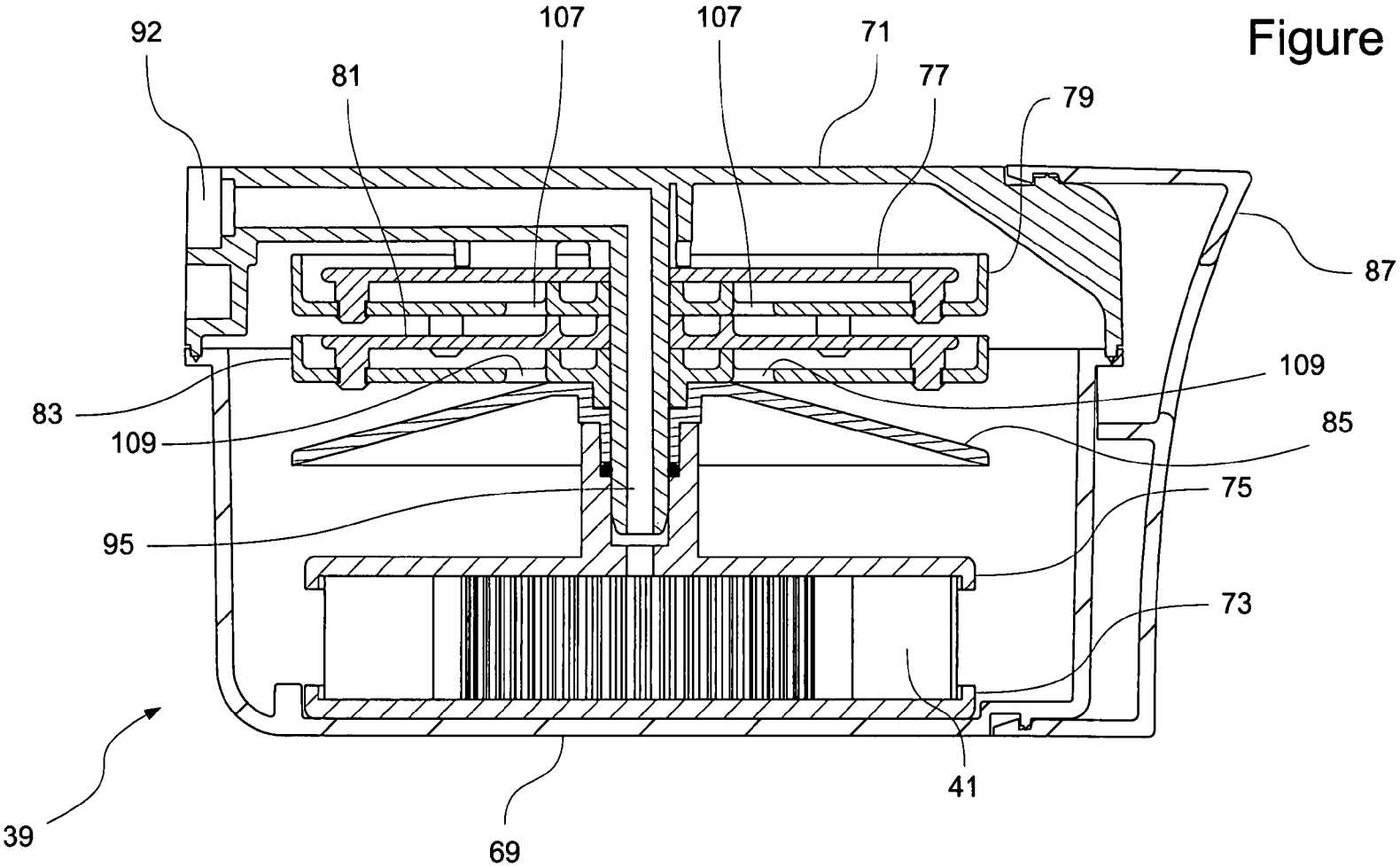
FIG. 7 shows a section through the ink feed tank of FIG. 5.

FIG. 7 is a longitudinal vertical section through the centre of the ink feed tank 39, and shows the arrangement of parts within the ink feed tank, after it has been assembled and closed. The inner stainless steel cylinder filter is omitted in FIG. 7 for clarity of illustration. The ink filter 41 sits at the bottom of the ink feed tank 39, with the filter assembly base plate 73 resting on the floor of the ink feed tank 39. The filter assembly top plate 75 has an upwardly extending central cylindrical extension, and the top of this supports the sloping conical plate 85 of the ink/air separator. This sloping conical plate 85 in turn supports the stack of four flat plates 77, 79, 81, 83. An ink outflow tube 95 is integrally moulded in the lid portion 71 of the ink feed tank 39, and extends from the port recess 92 across the underside of the lid portion 71 to a point above the centre of the stack of plates 77, 79, 81, 83, 85 and the filter assembly 73, 41, 75, and the ink outflow tube then extends downwardly through corresponding holes in the plates 77, 79, 81, 83, 85 and into the space at the axis of the cylindrical extension of the filter assembly top plate 75. When the ink feed tank 39 is fitted in the main printer body 1, the port plug 89 connects the inlet line of the ink pump 43 to the ink outflow tube 95. Accordingly, suction at the inlet of the pump 43 causes ink sitting in the ink feed tank 39 to be sucked through the ink filter 41, up through the centre of the filter assembly top plate 75, and out of the ink feed tank 39 through the ink outflow tube 95.

When the ink feed tank 39 is filled with ink for the first time, the space (approximately 40 ml) inside the annular ink filter 41 remains full of air. When the pump 43 is turned on, this air is sucked out through the ink outflow tube 95 while ink is sucked through the filter 41. In an alternative design, the ink outflow tube 95 extends down through the top plate 75 of the filter assembly and into the space within the cylindrical ink filter 41. However, this is less preferred because it has been found that with this design, when the pump 43 is first turned on after the ink feed tank 39 has been filled with ink, air is initially sucked out of the space enclosed by the filter only up to the level of the opening at the end of the ink outflow tube 95, and then ink passing through the filter is sucked up the ink outflow tune while air above this level is left behind. The remaining air may be discharged intermittently during subsequent operation. This is less preferred than a design that initially discharges all of the air enclosed by the filter 41.

Figure 9:
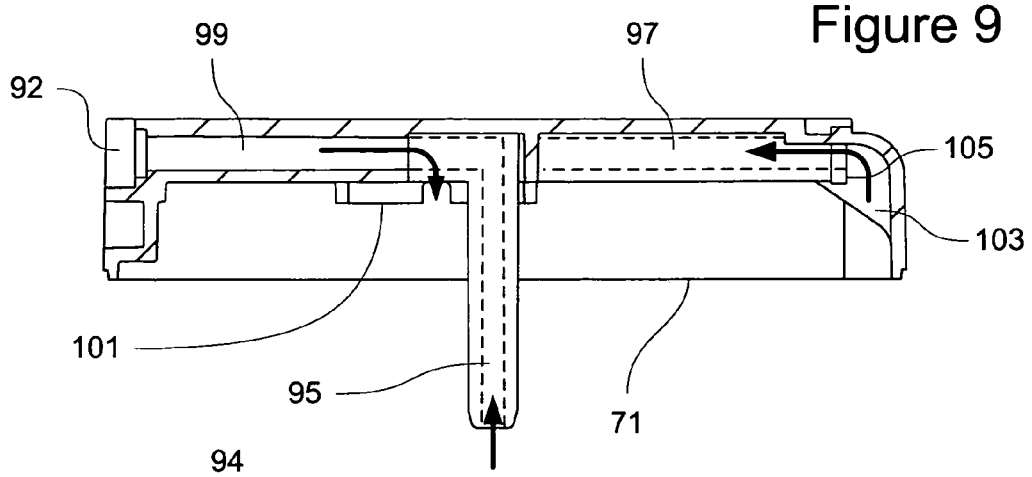
FIG. 9 shows a section through the lid portion of the ink feed tank of FIG. 5.
Figure 8:
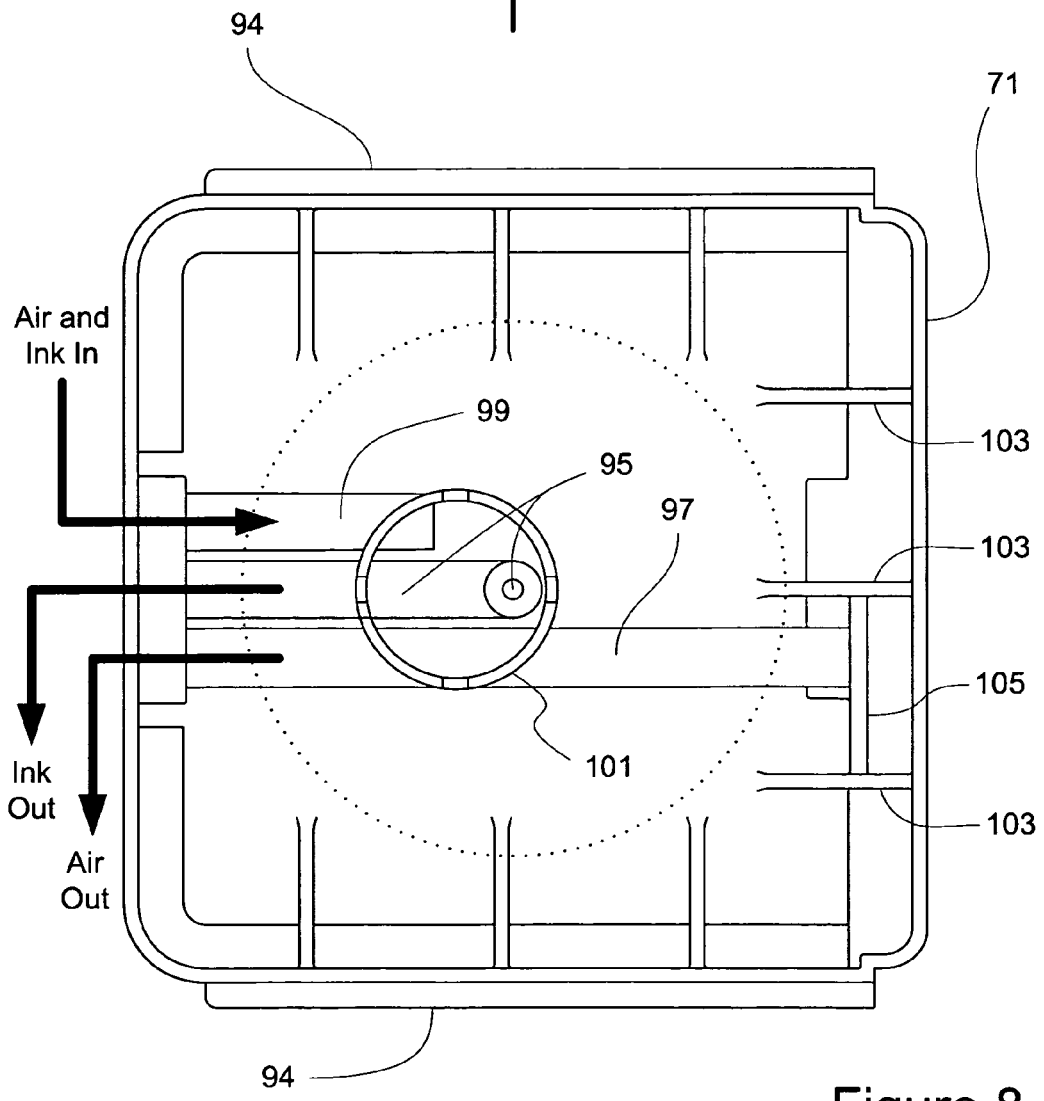
FIG. 8 is a view from below of the lid portion of the ink feed tank of FIG. 5.

As can be seen in FIGS. 8 and 9, the lid portion 71 of the ink feed tank 39 also includes an integrally formed air outflow tube 97 and an integrally formed inflow tube 99, in addition to the ink outflow tube 95. FIG. 8 is a view of the lid portion 71 from underneath (i.e. from within the ink feed tank 39). The position of the uppermost flat plate 77 of the ink/air separator is shown by a dotted line in FIG. 8. FIG. 9 is a simplified sectional view along the line of the inflow tube 99 (in contrast to FIG. 7, in which the lid portion 71 is sectioned through the ink outflow tube 95). The air outflow tube 97 should be visible in FIG. 7 but has been omitted for clarity of illustration. It is shown in FIG. 9.

The inflow tube 99 opens into a space enclosed by a circular wall 101 above the position of the topmost flat plate 77. The circular wall 101 extends downwardly almost to the top surface of the topmost flat plate 77. Four openings in the circular wall 101 allow the ink/air mixture, which has flowed out of the inflow tube 99 into the space enclosed by the circular wall 101, out of the enclosed space and over the top surface of the flat plate 77. (For convenience, the circular wall 101 is sectioned in FIG. 9 along the centre line of the lid portion 71 as in FIG. 7, and not along the same line as the rest of FIG. 9.)

The air outflow tube 97 extends almost all the way across the lid portion 71, and ends at a position between two strengthening ribs 103. A wall 105 extends between the two ribs 103 to act as a baffle, so that the air outflow tube 97 can only receive flow from a small volume that is only open downwardly. As will be explained later, the space above the ink in the ink feed tank 39 tends to fill almost entirely with an ink/air foam during operation of the printer, and this construction helps to prevent foam from entering the air outflow tube 97. For clarity of illustration, one of the strengthening ribs 103 has been omitted in FIG. 9 (the same rib is shown in section in FIG. 7).

Figure 10:
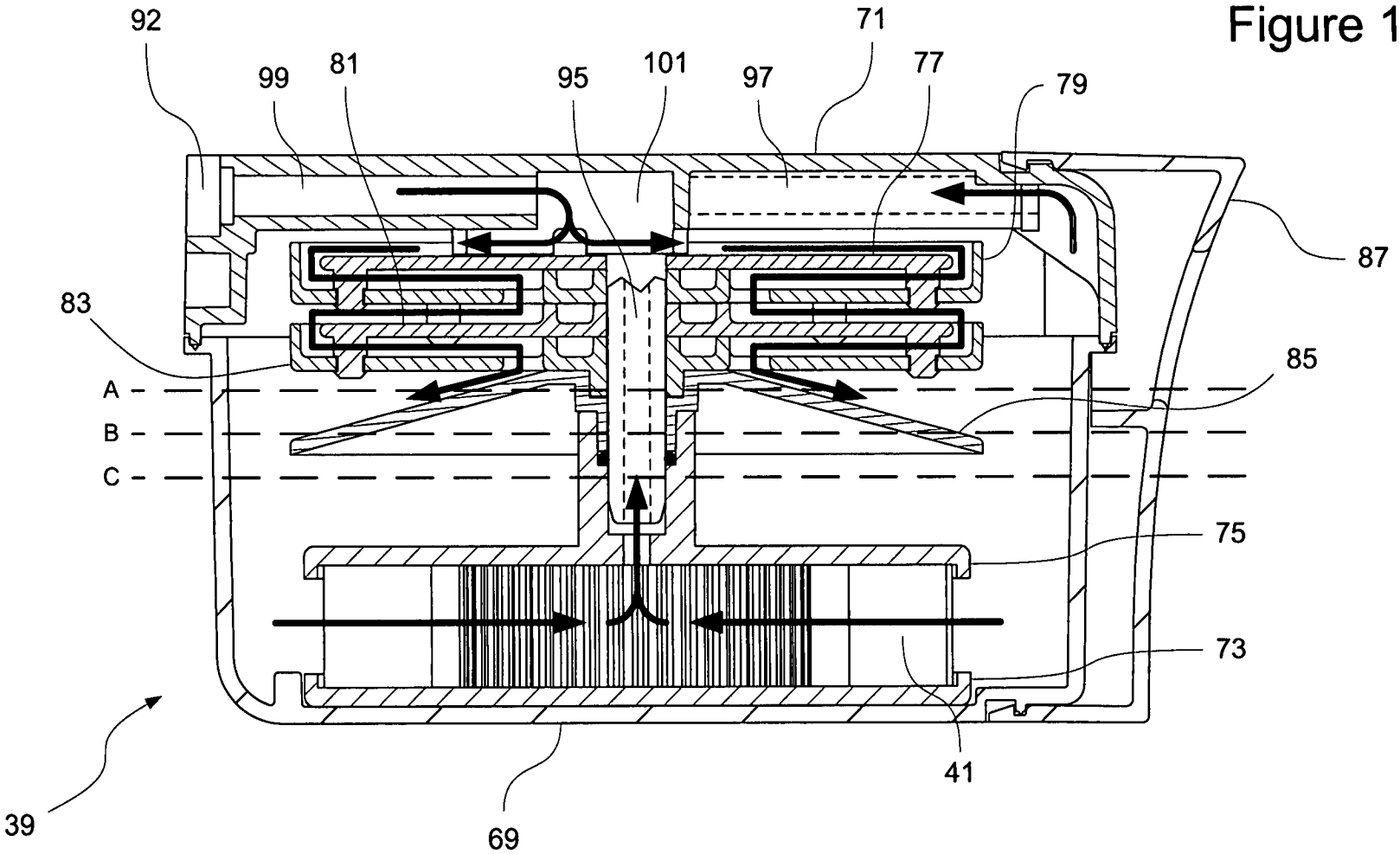
FIG. 10 is a further sectional view of the ink feed tank of FIG. 5, showing the path of fluid flow through the tank.

FIG. 10 is a section through the ink feed tank 39 similar to FIG. 7, except that the lid portion 71 has been sectioned in the same manner as FIG. 9 and part of the ink outflow tube 97 has been omitted so as to allow the inflow path of the ink/air mixture to be seen more clearly. The fluid flow into the ink feed tank 39 through the inflow tube 99, through the ink feed tank 39 and out through the ink outflow tube 95 and the air outflow tube 97, is marked in heavy lines in FIG. 10. Referring to FIGS. 7 and 10, the space below the lowermost flat plate 83 can accommodate up to about 600 ml of ink, and is intended to hold in the range of 400 ml to 600 ml of ink in normal use. In operation, the ink feed tank 39 of the illustrated embodiment is filled with approximately 500 to 550 ml of ink. This brings the top of the ink to a height part way up the conical plate 85. The surface of the ink is well above the top of the ink filter 41 (e.g. 20 mm to 25 mm above it), so that there is no danger of air from above the ink surface being sucked through the filter 41. The printer is intended to be operated with the main printer body 1 (in which the ink feed tank 39 is housed) mounted horizontally. However, even if the main body 1 and the ink feed tank 39 are mounted at a slope of 5°, the ink surface remains 10 mm to 15 mm above the top of the ink filter 41.

As the pump 43 operates, the main flow of ink is out of the ink feed tank 39 via the filter 41 and the ink outflow tube 95, through the pump 43 and the Venturi suction device 51, and back into the ink feed tank 39 through the inflow tube 99. Thus the ink volume in the ink feed tank 39 remains roughly constant. However, there will be a slow loss of solvent from the ink through evaporation, and there will be a slow consumption of ink during printing. These are compensated for by the solvent and ink top-up operations described above with reference to FIG. 4. The solvent top-up operation is performed in response to an increase in ink viscosity, which is detected by any suitable known method. As ink is consumed by printing, the ink level in the ink feed tank 39 will fall. Any suitable means (such as a float switch in the ink feed tank 39) may be used to detect this. When the ink level falls below a threshold, the ink top-up operation is performed to restore the volume of ink in the ink feed tank 39. The float switch or other ink level control is set to maintain the ink level in the ink feed tank 39 above the filter assembly 73, 41, 75 with a suitable safety margin (e.g. at least 5 mm) and below the lowermost flat plate 83. Typical upper and lower limits of the level of the top surface of the ink in the ink feed tank 39 are shown by the lines marked A and B in FIG. 10.

As can be seen in FIGS. 7 and 10, the ink/air separator comprises, from top to bottom, an upper rimless flat plate 77, an upper rimmed flat plate 79, a lower rimless flat plate 81, a lower rimmed flat plate 83 and a conical plate 85. The rimmed flat plates 79, 83 have a larger diameter than the rimless flat plates 77, 81. The flat plates 77, 79, 81, 83 are mounted as a coaxial stack on the conical plate 85, and the plates are supported by, and are coaxial with, the cylindrical extension of the top plate 75 of the filter assembly.

As shown in FIG. 10, the incoming ink/air mixture (delivered from the outlet of the Venturi suction device 51) flows from the inflow tube 99 into the space enclosed by the circular wall 101, and then flows out through the openings in the circular wall 101 so as to spread across the top surface of the uppermost flat plate of the ink/air separator, i.e. the upper rimless flat plate 77. When the ink/air mixture reaches the edge of the upper rimless flat plate 77 it flows over the edge of it and onto the upper rimmed flat plate 79. The ink/air mixture is retained by the rim of the upper rimmed flat plate 79, and flows toward the centre of the plate. The mixture then flows through flow holes 107 in the upper rimmed flat plate 79 near its centre, and onto the lower rimless flat plate 81. It then flows outwardly over the lower rimless flat plate 81, over its edge, and onto the lower rimmed flat plate 83. The mixture then flows inwardly over the lower rimmed flat plate 83 until it reaches flow holes 109 near the centre of the lower rimmed flat plate 83, and flows through the holes 109 onto the conical plate 85.

Because the ink/air mixture spreads out over the surface of the flat plates 77, 79, 81, 83, its flow is slow and smooth (non-turbulent), allowing the microbubbles mixed in with the ink to separate. The thickness of the plates (approximately 2 mm in the illustrated embodiment) and the separation between them (approximately 3 mm in the illustrated embodiment) is small enough that the drop from one plate to the next is not sufficient to create more bubbles or to disturb the smooth flow of the mixture. It has been found to be highly advantageous if the separation between the plates is adjusted so that when the ink/air mixture flows between two plates, it contacts the underside of the plate above it, without the separation being so small that it cannot accommodate the flow volume and the mixture overflows the rims of the rimmed flat plates 79, 83. It has been observed that the separation of the ink and air is less effective if the gap is so large that the mixture does not contact the underside of the plate above it. The best separation distance in any particular case is likely to depend on the volume flow rate through the ink feed tank 39 and also on the size (diameter) of the plates. In general, a separation between the plates in the range of from 2 mm to 5 mm is likely to be most useful.

It is believed that whenever a microbubble comes into contact with a surface of one of the flat plates 77, 79, 81, 83, it tends to cling to the plate and also slows or stops its movement. As microbubbles accumulate at the surfaces, they tend to clump together and combine with each other. This combination increases the size of the bubbles, so that they tend more readily to separate out from the ink under the influence of gravity. It is believed to be preferable that the ink-contacting surfaces of the flat plates 77, 79, 81, 83 or at least part of the ink-contacting surfaces) are textured so as to have a matt appearance, rather than to be smooth so as to have a gloss appearance. In the illustrated embodiment, a textured finish known as "coarse spark" is used, having an $R_a$ in the range of 16 to 18 μm (although a less rough surface can be used and in the prototype used for the experiments described below the surface had an $R_a$ of about 1.6 μm). It is believed that the roughness of the textured surface increases the effective surface area available to contact the microbubbles, both helping them to remain in contact with the surface and helping to slow or stop the flow of the microbubbles. In general, a surface finish with a non-specular appearance is preferred.

As the ink/air mixture flows between the flat plates 77, 79, 81, 83 of the ink/air separator, the retention of the microbubbles by the surfaces and the combination of the microbubbles to form bigger bubbles results in a degree of separation of the mixture into an air-rich layer contacting the underside of the plate above it, and an air-poor layer flowing over the upper surface of the plate below it. The air-rich layer is less dense that the air-poor layer, and so is more affected by friction (and possibly other surface effects) with the surface of the plate that it is in contact with, slowing its flow. This increases the time that the air spends between the flat plates 77, 79, 81, 83, thereby allowing more time for the air to separate from the ink. As a result, the separation between the layers becomes more distinct, and the air-rich upper layer becomes a foam. The foam tends to spill over the rims of the rimmed plates 79, 83, while the air-poor ink layer follows the path described above.

In experiments with the illustrated embodiment in a Linx, printer using an ethanol-based ink, it is believed that by the time the ink flowed through the flow holes 109 in the lower rimmed flat plate 83, and onto the conical plate 85, about 70% to 80% of the air initially contained in the ink/air mixture had separated into the foam layer, and about 20% to 30% of the initial air was still mixed in with the ink flow onto the conical plate. It was observed that substantially all of the air volume of the ink feed tank 39 (the volume above the ink held in the tank) filled with foam. However, if the ink pump 43 was turned off, so that flow through the ink feed tank 39 and the Venturi suction device 51 stopped, the foam dissipated with a few seconds, indicating that the foam is unstable and disintegrates rapidly. The air released by disintegration of the foam enters the air outflow tube 97 from the space enclosed by the baffle wall 105 and strengthening ribs 107.

In normal operation, the top surface of the main volume of ink in the ink feed tank 39 will usually be between lines A and B in FIG. 10. The ink that has passed over the flat plates 77, 79, 81, 83, still containing 20% to 30% of the initial air, flows through the flow holes 109 in the lower rimmed flat plate 83 and onto the conical plate 85. It spreads down the upper sloping surface of the conical plate 85 and flows smoothly into the main volume of ink. As with the surfaces of the flat plates 77, 79, 81, 83, the upper sloping surface of the conical plate 85 is preferably roughened. Because of the gentle slope of the conical plate 85, and the fact that the top surface of the ink in the bottom of the ink feed tank 39 is above the lower edge of the conical plate 85, the flow of ink down it does not mix into the ink already sitting in the bottom of the ink feed tank 39 but instead flows smoothly on top of it. The small amount of air still contained in the ink that has just flowed down the conical plate 85 to join the main ink volume gives it a slight buoyancy as compared with the de-aerated ink below it. Therefore the newly-joined ink floats on top of the main ink volume and the remaining bubbles in it are not mixed into the ink lower down.

Since the amount of air in the ink is greatly reduced, and at least some of the air bubbles will be larger than the microbubbles in the ink/air mixture as it initially entered the ink feed tank 39 through the inflow tube 99 (because they will have undergone aggregation and combination as they passed between the flat plates even if the resulting bubbles and aggregations were not large enough to float up into the foam), the volume of ink in bottom of the ink feed tank 39 is sufficient for substantially all of the remaining air to settle upwardly out of the ink before the ink reaches the filter 41, so that substantially no air is sucked through the filter 41. The freshly-joined ink that has flowed down the conical plate 85 and into the main ink volume forms an air-containing layer roughly 5 mm deep at the top of the main ink volume, and there is substantially no air in the ink below the level of line C in FIG. 10. The de-aerated ink at the bottom of the ink feed tank 39 passes through the ink filter 41, flows upwardly through the filter assembly top plate 75, and out of the ink feed tank through the ink outflow tube 95 under the influence of suction from the inlet of the pump 43.

In the illustrated embodiment, the upper sloping surface of the conical plate 85 is at about 15° below horizontal. The angle is chosen to be shallow enough that the ink flowing down the surface joins the main ink volume smoothly and is not carried appreciably below the surface of the main ink volume, while being steep enough that the height drop over the surface is sufficient to accommodate all surface heights of the main ink volume expected to arise in normal use. In any particular arrangement, the range of acceptable angles will depend on other design factors of the arrangement, such as the nature of the system to maintain the ink volume in the ink feed tank 39 (and therefore the ink surface height range that must be accommodated). In practice, it is expected that a slope of at least 10° will be required, and that the slope should not exceed 45°. Preferably the slope does not exceed 30°, and more preferably does not exceed 20°.

FIG. 11 is a top view of the upper rimless flat plate 77 and FIG. 12 is a section through the upper rimless flat plate 77. FIGS. 13 and 14 are corresponding views of the upper rimmed flat plate 79. FIGS. 15 and 16 are corresponding views of the lower rimless flat plate 81. FIGS. 17 and 18 are corresponding views of the lower rimmed flat plate 83. FIGS. 19 and 20 are corresponding views of the sloping conical plate 85.

Each of the plates 77, 79, 81, 83 85 has a central hole 111 through which the ink outflow tube 95 of the lid portion 71 of the ink feed tank 39 passes when the parts are assembled together. Each of the upper rimless flat plate 77, the upper rimmed flat plate 79 and the lower rimless flat plate 81 has securing members 113, for attaching it to the plate below. These take the form of downwardly extending studs, which clip (snap fit) through securing holes 115 in the plate below. The securing holes 115 are formed in the upper rimmed flat plate 79, the lower rimless plate 81 and the lower rimmed plate 83. The arrangement of securing members 113 and securing holes 115 holds the stack of flat plates 77, 79, 81, 83 together and also keeps them the correct distance apart. There are no securing members on the lower rimmed flat plate 83 because there is no flat plate below it, and there are no securing holes 115 in the upper rimless flat plate 77 because there is no flat plate above it.

Each of the upper rimmed flat plate 79, the lower rimless flat plate 81 and the lower rimmed flat plate 83 has a first wall 117 co-axial with and adjacent the central hole 111, and a second wall 119 coaxial with the central hole 111 and spaced a short distance outwardly from the first wall 117. These walls 117, 119 extend upwardly to the plate above and help to support it, and also help to keep the plates the correct distance apart. The upper rimless plate 77 has no walls 117, 119 since there is no plate above it. The first wall 117 of the lower rimmed flat plate 83 (which is the lowest flat plate) also extends downwardly, and when the parts are assembled this downward extension fits into a recess 121 in the conical plate 85 around its central hole 111. This locates the stack of flat plates and the conical plate in the correct relative positions during assembly, before the top and bottom portions of the ink feed tank have been closed together. Similarly, the conical plate 85 has a wall 123 extending downwardly from the recess 121, coaxial with and adjacent its central hole 111. This fits into a corresponding recess in the top of the cylindrical extension of the top plate 75 of the filter assembly (see FIGS. 7 and 10), and locates the plates in the correct position relative to the filter assembly before the top and bottom portions of the ink feed tank have been closed together.

Each of the rimmed flat plates 79, 83 has a circumferential upwardly extending rim 125, and flow holes 107, 109 adjacent the second wall 119, as already discussed with reference to FIG. 10. The rim 125 holds the ink/air mixture on the plate and prevents it from flowing over the edge, so that the mixture has to flow radially inwardly and leave the top surface of the plate through the flow holes 107, 109. Consequently, the flow holes 107, 109 can provide a flow restriction effect under some circumstances, and the number and size of the flow holes 107, 109 can be selected to provide a further control over the flow rate of the ink/air mixture through the stack of flat plates.

The inner side of the rim 125 on each of the rimmed flat plates 79, 83 is at a diameter that is larger than the diameter of the rimless flat plate 77, 81 above it, to ensure that the ink/air mixture overflowing the edge of the rimless flat plate is caught by the rimmed flat plate. For example, the rimless flat plates may have a diameter of 95 mm, and the inner side of the rim 125 on each rimmed flat plate may be at a diameter of about 100 mm. As shown in the drawings, in the present embodiment the two rimless flat plates 77, 81 are the same diameter as each other and the two rimmed flat plates are the same diameter as each other. This is convenient and makes efficient use of space, but is not essential.

As discussed above, the principal function of the sloping conical plate 85 is to deliver the ink flow from the flat plates to the top of the main volume of ink in the ink feed tank 39 without significant mixing, so that the small residue of air still mixed in with the freshly-delivered ink does not get carried down to the level of the ink filter 41. However, the presence of the conical plate 85 not essential although it is preferred, and it has been found that good ink/air separation is achieved even in its absence, as is shown in the discussion of experiments below.

EXPERIMENTS

Tests were conducted on various configurations of the ink feed tank 39 to determine the effectiveness of the ink/air separator in removing air from the ink. During the tests, the ink feed tank 39 was fitted in a newly developed Linx ink jet printer with the general schematic fluid layout shown in FIG. 4.

Three configurations of the ink feed tank were used. In Example 1, the ink feed tank 39 was as shown in FIGS. 7 and 10. In Example 2 the ink feed tank 39 was the same, except that the sloping conical plate 85 was removed. In Comparative Example 3 all of the flat plates 77, 79, 81, 83 as well as the sloping conical plate 85 were removed (i.e. ink/air mixture fell directly from the inflow tube 99 into volume of ink in the lower part of the ink feed tank 39). In all three configurations, a syringe was fitted so as to suck fluid from the space enclosed by the ink filter 41, in order to allow fluid samples to be drawn off for inspection.

Three Test Procedures were performed to test the performance of the three ink feed tank configurations in removing air from the ink. Test Procedure 1 included the following steps:

- Fill the ink feed tank base portion 69 with 550 ml of Linx 2035 (ethanol-based) ink
- Connect the hypodermic syringe to the filter assembly;
- Place the ink feed tank lid portion 71, together with the plates (except in the case of Comparative Example 3), filter assembly and hypodermic syringe into the base portion 69;
- Connect the ink feed tank 39 to the fluid system as shown in FIG. 4;
- Run the printer for 3 hours; and
- Every hour, remove 20 ml of ink from within the filter assembly by means of the syringe, and record the amount of air included in the withdrawn ink sample.

Test Procedure 2 was the same as Test Procedure 1 except that the printer base was set at a 5° incline with respect to horizontal. This was to test the ability of the ink feed tank to avoid passing air to the ink pump 43 when the printer is not precisely level.

Test Procedure 3 was the same as Test Procedure 2 (i.e. it included setting the printer base at 5°), except that instead of running for 3 hours, the running time was 30 minutes, and 60 ml of ink was withdrawn from the filter assembly via the syringe and the amount of air in the withdrawn ink sample was recorded.

The amount of air found in the ink samples from the tests is shown on the table below:

| Design | Test 1 | Test 2 | Test 3 |
|---|---|---|---|
| Example 1 | no air | no air | no air |
| Example 2 | no air | no air | small traces of air |
| Comparative Example 3 | not done | not done | 1.5-2 ml air in withdrawn sample |

The result for Comparative Example 3 shows that if air microbubbles reach the ink filter 41, air can be drawn through the filter. Such air passing through the filter 41 will pass through the ink pump 43 and may be included in the ink used to form the ink jet, with undesirable results as discussed above. The results for Examples 2 and 3 show that the flat plates 77, 79, 81, 83 were effective in removing air from the ink/air mixture entering the ink feed tank 39. It is not clear whether the result for Example 2 in Test 3 indicated a trace of air passing through the filter 41, and so although it is believed that the presence of the sloping conical plate 85 is beneficial, this is not conclusively established by these tests. The results for Tests 2 and 3 show that the ink/air separator and the overall layout of the ink feed tank and the components contained within it are effective even when the printer main body 1 is placed at a slight slope. This helps to make the printer easier to use, as it means that the surface on which the main body 1 is placed in use does not need to be precisely horizontal.

FURTHER EMBODIMENTS

The embodiment described above and shown in FIGS. 5 to 20 is currently preferred, but many alternative embodiments are possible and the features of the embodiment are not essential.

Figure 21:
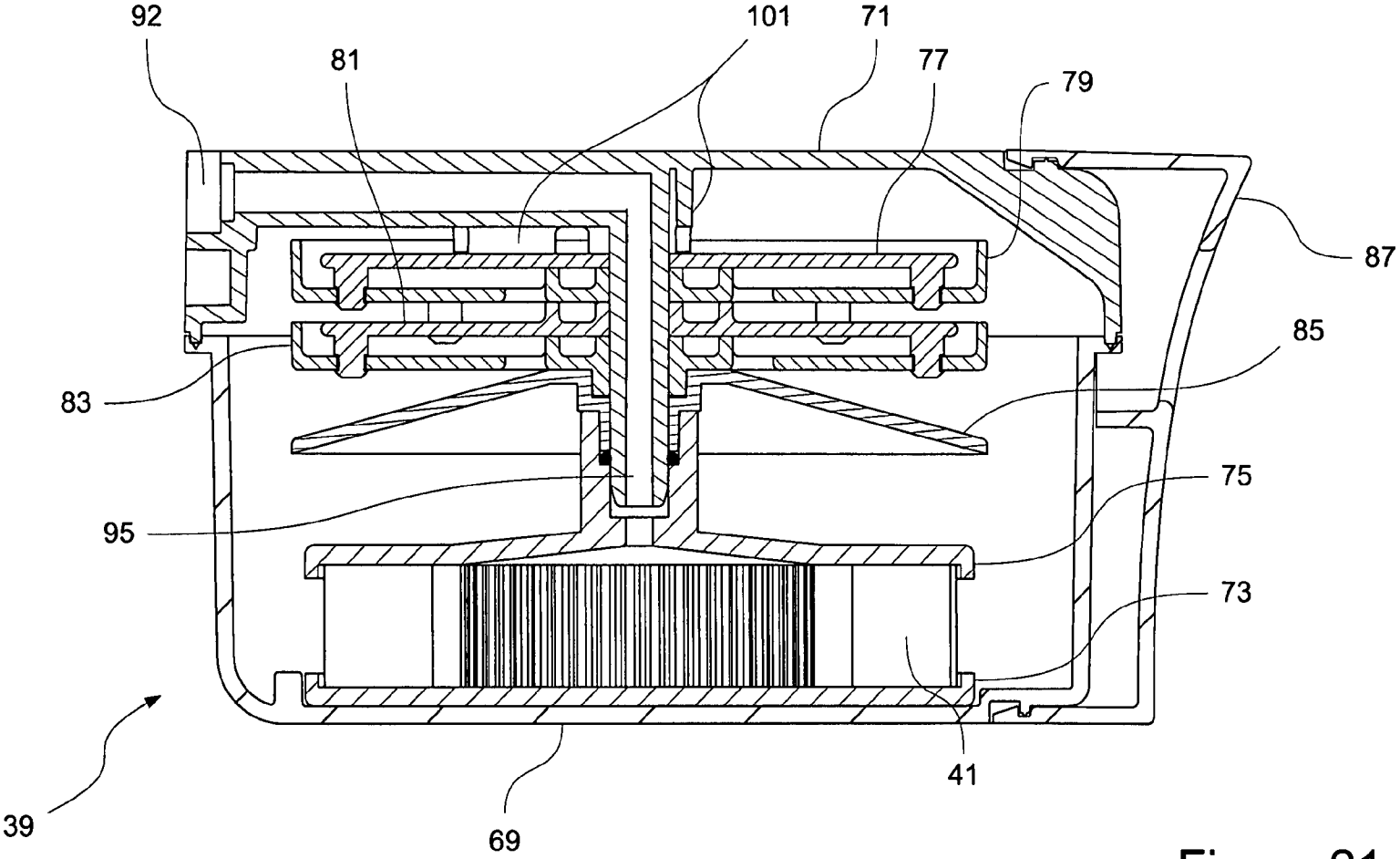
FIG. 21 is a sectional view through the ink feed tank, similar to FIG. 7, showing an alternative construction for the ink filter assembly.

FIG. 21 shows an alternative construction in which the top plate 75 of the filter assembly is angled upwardly towards the point where ink flows out of the volume enclosed by the filter 41. This shape may assist in ensuring that air in this space is sucked out immediately the printer is started and does not remain inside the filter assembly during printer operation.

Additionally, the number of flat plates may be varied. In the embodiment illustrated in FIGS. 5 to 20, when tested with an ethanol-based ink in a Linx printer having a fluid layout substantially as shown in FIG. 4, it was found that the ink/air separation was significantly worse if only two flat plates were used, and that four flat plates were adequate. Additional flat plates could have been incorporated, but this would have increased the overall height of the design. However, when used with other designs of printer or if the size of the individual plates is altered, it may be found that fewer plates may be sufficient or that more plates may be required. For example, in a printer design in which gutter suction is provided by a suction pump, rather than a Venturi suction device, the ink/air mixture may include only the ink that has passed along the gutter line 33, in which case the total volume flow rate of the ink/air mixture may be substantially less than when a Venturi suction device is used, and the proportion of air in the mixture may be substantially more. If an ink/air separator is to be used with such a printer, the optimum number of plates may be different from the number required if the printer was otherwise comparable but used a Venturi suction device.

It is believed that the flat plates 77, 79, 81, 83 work by slowing down the flow of the ink/air mixture, spreading it out, and providing surfaces with which the microbubbles can interact. Accordingly, the plates should be generally horizontal in use, but do not necessarily need to be strictly flat. The surfaces of the plates over which the ink/air mixture flows may be slightly dished or domed, or may be ridged or have other surface features provided that these do not significantly speed up the flow of the mixture over the surface of the plate or significantly concentrate the flow into a narrow path (as opposed to letting the flowing mixture spread out). Additionally, the plates 77, 79, 81, 83, 85 are circular in the embodiment of FIGS. 5 to 18 for convenience of manufacturing and assembly, but this shape is not essential and other shapes may be used. The sloping plate 85 does not have to be conical, and may for example be pyramidal, although a conical upper surface is preferred as it tends to spread the ink out more evenly than other shapes.

Figure 22:
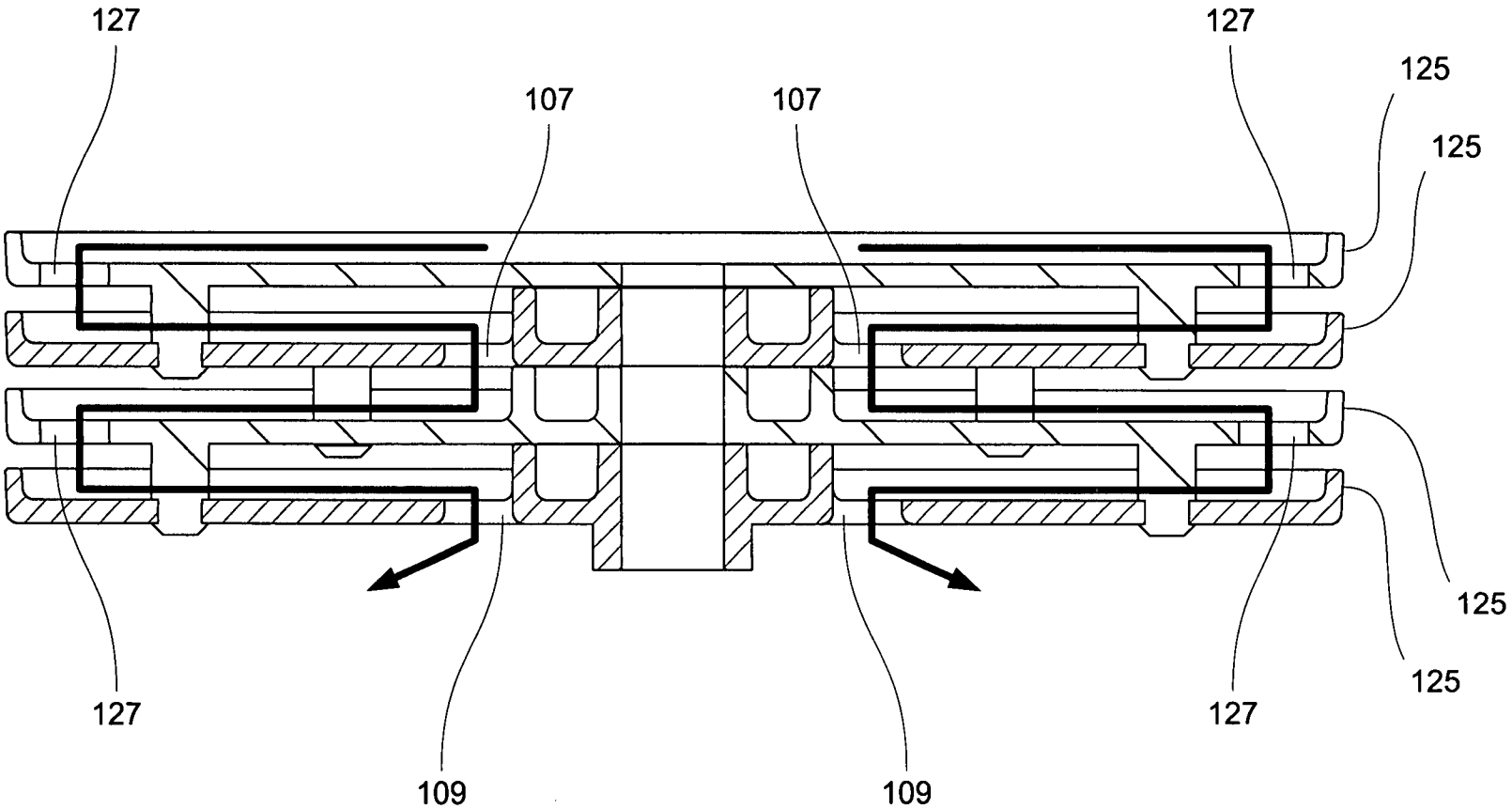
FIG. 22 shows a section through the flat plates of an ink/air separator according to a second embodiment of the present invention.

FIG. 22 shows a construction for the flat plates of the ink/air separator in which the flow does not pass over the edge of any of the plates. Instead all of the plates have rims 125, and they all have flow holes 107, 109, 127 to allow the ink to pass from one plate to the next. As in the plate design shown in FIGS. 7 and 10 to 18, alternate plates have flow holes 107, 109 near the centre of the plate. The other plates have flow holes 127 near the periphery of the plates. The ink flow path is shown by heavy lines.

Figure 23:
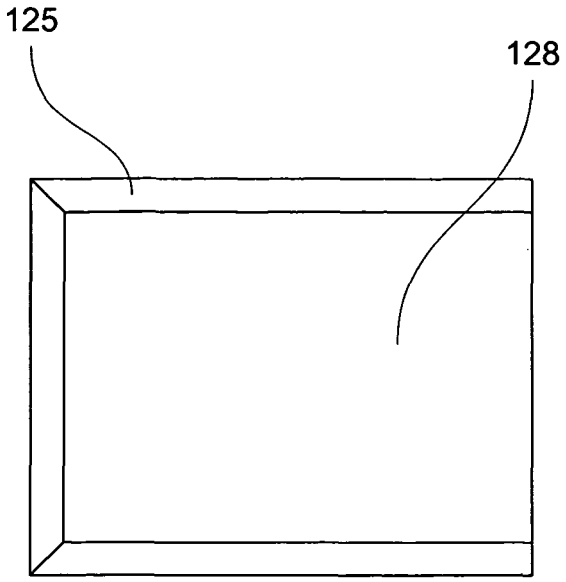
FIG. 23 is a plan view of a plate in an ink/air separator according to a third embodiment of the present invention.
Figure 24:
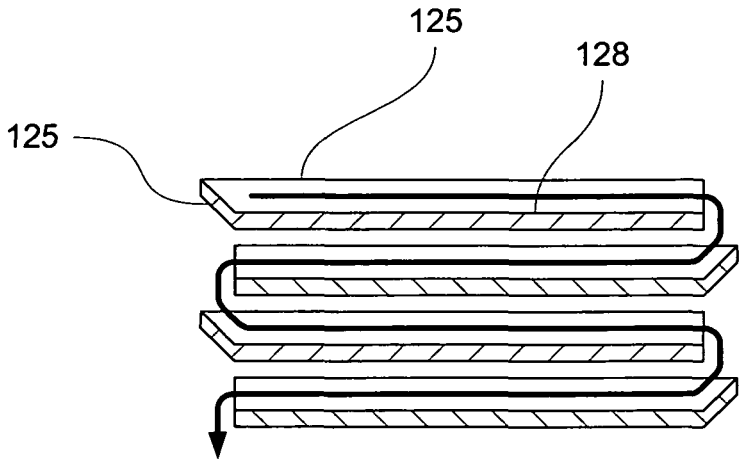
FIG. 24 shows a section through an ink separator of the third embodiment, using plates as shown in FIG. 23.

In the above embodiments, the flow path of the ink/air mixture through the plates is from the centre of a plate to the periphery or from the periphery to the centre (approximately radial flow). This is preferred as it tends to help the ink/air mixture to spread out over the surface of the plates rather than all the mixture following the same path, but it is not necessary. FIG. 23 is a plan view of an alternative construction for the flat plates, and FIG. 24 is a section through a stack of such plates 128. In this embodiment, the flow path is from side to side, as shown by the heavy line. Additionally, this embodiment illustrates a non-circular shape for the plates. Each plate 128 has a rim 125 on three sides and not on the fourth side, to accommodate the side-to-side flow. The rims 125 are sloping rather than vertical, so that flow from one plate can be caught by the rim on the plate below. This embodiment of the ink/air separator is designed to be used in a system where the outflow path of de-aerated ink is not through the plates of the separator, and so the plates do not have holes 111 to accommodate the ink outflow tube 95.

Figure 25:
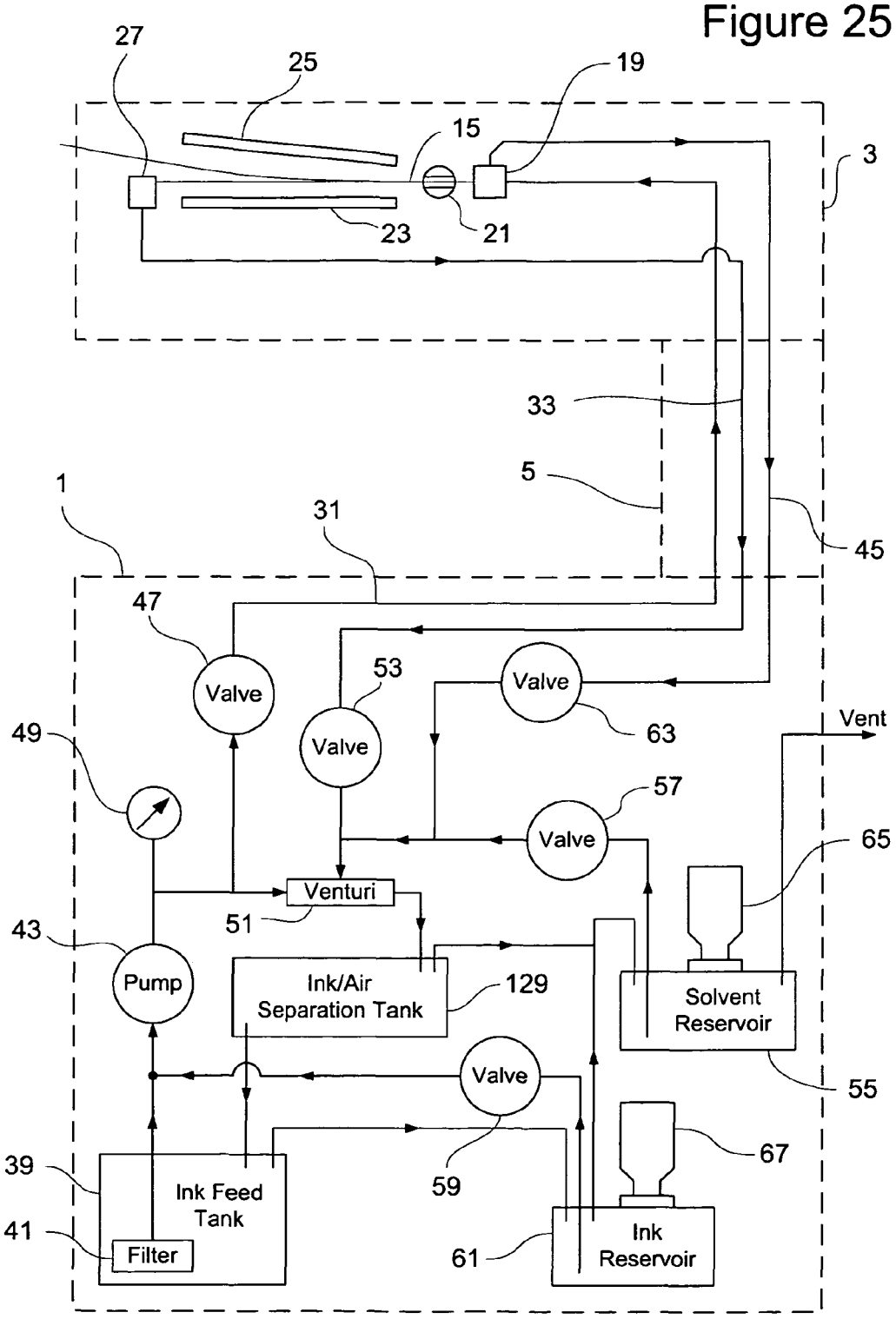
FIG. 25 is a schematic diagram of part of the fluid system, similar to FIG. 4, in a fourth embodiment of the present invention.

FIGS. 5 to 19 show an ink feed tank in the form of a self-contained removable and replaceable service module, containing both the ink/air separator and the ink filter, and the fluid layout of FIG. 4 is designed to use such an arrangement. However, it is also possible to place the ink/air separator in a separate tank from the ink filter 41. The fluid layout for such an arrangement is shown in FIG. 25. This is similar to FIG. 4, except that the fluid flow from the Venturi suction device 51 now passes to an ink/air separation tank 129 (sometimes known as a settling tank), which contains the ink/air separator. Air is at least partially separated from the ink in the ink/air separation tank 129. The air is vented in the same way as for the ink feed tank of FIG. 4 (for example, FIG. 25 shows a vent connection from the ink/air separation tank 129 to the solvent reservoir 55). The ink, that has been at least partially de-aerated, flows from the ink/air separation tank 129 to the ink feed tank 39, e.g. by gravity (although means to drive the flow, such as a pump, could be provided). In this embodiment, the ink feed tank 39 contains the ink filter 41 but does not need to contain an ink/air separator.

FIG. 26 shows a section through an ink/air separator tank 129 usable in the fluid layout of FIG. 25. The flow path of ink through the ink/air separation tank 129 is marked in heavy lines in FIG. 26. The tank contains an ink/air separating arrangement comprising flat plates 77, 79, 81, 83 and a sloping plate 85 that is largely similar to the arrangement shown in shown in FIG. 10. However, the sloping plate 85 has a downwardly extending rim at its outer edge, and sits on the floor of the ink/air separator tank 139. Apertures 131 in the rim of the sloping plate 85 allow ink, that has been at least partially de-aerated as it flowed over the flat plates 77, 79, 81, 83, to enter the space beneath the sloping plate 85 and flow to an ink outflow hole 133 in the floor of the ink/air separation tank 129. The floor of the tank 129 around the ink outflow hole 133 slopes towards the hole, to assist the ink to drain out of the tank.

The ink/air separation tank 129 of FIG. 26 has an inflow tube 99, a circular wall 101 around the opening of the inflow tube 99, and an air outflow tube 97 (not shown in FIG. 26) in the same way as the ink feed tank 39 of FIGS. 5 to 10. However, because the ink flows out through the ink outflow hole 133 in the floor of the ink/air separation tank, there is no ink outflow tube 95. As a result, there is no central hole 111 in the upper rimless plate 77, in the upper rimmed plate 79, nor in the lower rimless plate 81, and these plates also do not have the walls 117, 119. The multiple flow holes 107 in the upper rimmed plate 79 are replaced by a single enlarged flow hole 135 at the centre of the plate. These changes increase the surface area of the plates over which the ink/air mixture flows.

The ink/air separation tank 129 can be made as a user-removable and replaceable module, in a similar way to the ink feed tank 39. However, this is not necessary since it is anticipated that there will not normally be any need to replace the ink/air separation tank 129.

FIG. 27 shows a section through an ink feed tank 39 usable in the fluid layout of FIG. 25. The flow path of ink through the ink feed tank 39 is marked in heavy lines in FIG. 27. The ink feed tank 39 contains an ink outflow tube 95, an air outflow tube 97, an inflow tube 99, and a filter assembly comprising the ink filter 41, a filter assembly base plate 73 and a filter assembly top plate 75, in the same way as the ink feed tank 39 of FIGS. 5 to 10. The inflow tube 99 is not visible in FIG. 27 because the section line passes along the ink outflow tube 95. The ink feed tank 39 of FIG. 27 does not contain any flat plates 77, 79, 81, 83. As shown in FIG. 27, it may nevertheless be useful to include a sloping plate 85 in the ink feed tank 39 of this embodiment, positioned so that the ink entering through the inflow tube 99 is delivered directly onto the top central surfaced of the sloping plate 85, so as to provide an arrangement by which ink entering the ink feed tank 39 is delivered to the top of the volume of ink already in the ink feed tank 39 without excessive mixing or turbulence. However, other arrangements are possible which do not include a sloping plate, such as one in which the ink initially flows into a separate section of the tank, separated from the remainder of the ink feed tank 39 by a vertical wall, so that the ink flows from the separate section into the remainder of the ink feed tank 39 by overflowing the vertical wall, thereby ensuring that the freshly-arrived ink joins the upper part of the main volume of ink and does not have any significant downward momentum when it joins.

The ink feed tank 39 of FIG. 27 is made as a self-contained removable and replaceable module, to allow easy servicing of a printer by the operator. Although not shown in FIG. 27, it may be fitted with a handle 87 in a similar manner to the ink feed tank of FIGS. 5 to 10. As compared with the ink feed tank of FIGS. 5 to 10, the ink feed tank 39 of FIG. 27 is less high since it does not need to allow space for the flat plates 77, 79, 81, 83. This results in a smaller and more convenient replaceable module. However, the total space occupied by the ink feed tank 39 of FIG. 27 and the ink/air separation tank 129 of FIG. 26 is likely to be greater than the space occupied by the ink feed tank 39 of FIGS. 5 to 10, and so more space inside the main body 1 of the printer is required.

In the embodiments, where a flat plate 77, 79, 81, 83, 128, or a region thereof, is described or shown without a rim, there may alternatively be an intermittent rim with gaps to allow liquid flow through the gaps. Provided that the rim portions between the gaps are sufficiently short, so that the gaps are sufficiently close together, the natural tendency of the ink/air mixture to spread out on the next plate in the separation arrangement will have the result that the ink will be distributed over that plate substantially in the same manner as it would be if there had been no rim at the position of the intermittent rim on the plate above.

Several embodiments of the present invention have been described. Further embodiments and variations will be apparent to those skilled in the art. It will also be apparent to those skilled in the art that individual features from the embodiments may be altered, removed or replaced, and different features from different embodiments may be used in combination with each other. Moreover, any combination of the above-described elements in all possible variations thereof is encompassed by the invention unless otherwise indicated herein or otherwise clearly contradicted by context. The inventors expect skilled artisans to employ such variations, alterations, replacements and combinations as appropriate in any circumstances that may arise, and the inventors expect and intend the invention to be practiced differently from the manner described herein in addition to practice as described herein. Accordingly, any feature that is not recited in all independent claims should not be regarded as essential to the present invention, and this invention includes all modifications and equivalents of the subject matter recited in the claims appended hereto as permitted by applicable law. Furthermore, the ink/air separation arrangement, the ink feed tank, the ink/air separation tank and a removable module comprising any of them, are aspects of the present invention even when separate from an ink jet printer in which they may be used. These aspects of the present invention may be manufactured and sold separately from any ink jet printer in which they are intended to be used, and the present application and any patent granted on it are intended to extend so as to cover these aspects independently of any ink jet printer.

The invention claimed is:

1. An arrangement suitable for use in an ink jet printer, for separating air, at least partially, from ink, the arrangement comprising:

a fluid inlet for receiving ink from which air is to be separated;

a plate portion comprising a plurality of plates, including a first plate positioned below the fluid inlet so that ink that has been received by the fluid inlet flows onto an upper surface of the first plate and flows across at least a part of the upper surface;

a space below the plate portion for receiving ink that has passed over at least the first plate; and a fluid outlet for ink that has been received in the said space, and in which the plurality of plates are arranged at least partially overlapping each other and one above the next so that ink that has been received by the fluid inlet flows across the top surface of a plurality of plates in turn before being received in the said space, and at least one pair of adjacent plates is are separated by a gap of 2 mm to 5 mm where they overlap.

2. An arrangement according to claim 1 in which at least one pair of adjacent plates are separated by a gap of approximately 3 mm where they overlap.

3. An arrangement according to claim 1 in which at least one pair of adjacent plates are substantially parallel where they overlap.

4. An arrangement according to claim 1 in which the first plate is substantially planar.

5. An arrangement according to claim 1 in which the plate portion comprises at least one plate of which at least part of the upper surface is textured.

6. An arrangement according to claim 1 in which the plate portion comprises at least one plate of which at least a part has a rim to prevent ink from overflowing the edge of the at least a part of the plate.

7. An arrangement according to claim 6 in which the said at least one plate has a hole through it to allow ink to flow through the plate.

8. An arrangement according to claim 1 in which the plate portion comprises at least one plate of which at least a part is rimless, to allow ink to overflow at least a part of the edge of the plate.

9. An arrangement according to claim 1 comprising a sloping plate below the plate portion, positioned to receive ink from the plate portion and deliver it to the said space.

10. An arrangement according to claim 1 comprising a tank, the tank enclosing the said space, the plate portion being inside the tank, and the fluid inlet and the fluid outlet passing through a wall of the tank.

11. An arrangement according to claim 1 comprising an ink filter positioned in the space below the plate portion.

12. An ink/air separator, suitable for use in a continuous ink jet printer, the separator comprising:

a tank;

a plurality of substantially planar plates within the tank arranged at least partially overlapping each other and one above the next, and at least one pair of adjacent plates being separated by a gap of 2 mm to 5 mm where they overlap;

an inlet for liquid entering the tank, the inlet being positioned so that if the tank is disposed in an orientation such that a first plate of the plurality of substantially planar plates is horizontal, liquid entering the tank via the inlet is delivered to a top surface of one of the plates and flows across the top surfaces of a plurality of the plates in turn;

there being space in the tank, lower than the plurality of substantially planar plates when the tank is in the said orientation, into which liquid that has flowed over said top surfaces may pass; and the separator further comprising an outlet for liquid leaving the tank, the outlet being positioned to receive liquid from the said space.

13. A method of separating air from ink in a continuous ink jet printer, comprising passing an ink/air mixture under a lower surface of a first plate and simultaneously over an upper surface of a second plate, the lower surface of the first plate and the upper surface of the second plate both contacting the ink/air mixture, and collecting ink that has passed under the first plate and over the second plate in a space below the plates, wherein the ink/air mixture comprises ink and air that have been received from a gutter of the continuous ink jet printer.

14. A method according to claim 13 in which there is a sloping plate, and the ink flows over the sloping plate after passing under the first plate and over the second plate and before being collected in the said space.

15. A method according to claim 13 in which the first and second plates are substantially planar.

16. A method according to claim 15 in which the first and second plates are substantially horizontal.

17. A method according to claim 13 in which at least part of at least one plate surface over which the ink flows is textured.

18. A method according to claim 13 in which the ink flows radially inwardly over the surface of one plate and then radially outwardly over the surface of another plate, or vice versa.

* * * * *